US011400456B2

(12) United States Patent
Osakada et al.

(10) Patent No.: US 11,400,456 B2
(45) Date of Patent: Aug. 2, 2022

(54) APPARATUS AND PROCESS FOR PRODUCING SURFACE-WORKED GRANULAR PRODUCT

(71) Applicants: YAMATO SANGYO Co., Ltd., Nagoya (JP); TSUKUBA FOOD SCIENCE, INC., Ushiku (JP)

(72) Inventors: Satoshi Osakada, Nagoya (JP); Toru Hoshino, Nagoya (JP); Sumiyo Yamada, Ushiku (JP); Akira Horigane, Ushiku (JP)

(73) Assignees: YAMATO SANGYO Co., Ltd., Nagoya (JP); TSUKUBA FOOD SCIENCE, INC., Ushiku (JP)

( * ) Notice: Subject to any disclaimer, the term of this patent is extended or adjusted under 35 U.S.C. 154(b) by 220 days.

(21) Appl. No.: 16/136,994

(22) Filed: Sep. 20, 2018

(65) Prior Publication Data

US 2019/0083984 A1 Mar. 21, 2019

(30) Foreign Application Priority Data

Sep. 21, 2017 (JP) ..... JP2017-181791

(51) Int. Cl.
*B02B 3/02* (2006.01)
*B02B 7/02* (2006.01)
(Continued)

(52) U.S. Cl.
CPC ..... *B02B 3/02* (2013.01); *B02B 3/04* (2013.01); *B02B 7/02* (2013.01); *B02B 3/00* (2013.01)

(58) Field of Classification Search
None
See application file for complete search history.

(56) References Cited

U.S. PATENT DOCUMENTS 4,324,175 A * 4/1982 Satake ..... B02B 3/04 99/519
4,463,665 A 8/1984 Satake et al.
(Continued)

FOREIGN PATENT DOCUMENTS

JP 31-5641 4/1956
JP 35-10663 8/1960
(Continued)

OTHER PUBLICATIONS

Japan Office Action, with English translation, issued in corresponding Japanese Patent Application No. 2017-181791 dated Apr. 6, 2021 (12 pages).
(Continued)

*Primary Examiner* — Reginald Alexander
(74) *Attorney, Agent, or Firm* — Flynn Thiel, P.C.

(57) ABSTRACT

A surface-worked granular product is produced by supplying raw granular material to a cylindrical retainer having apertures and retaining sites, floating the granular material by suctioning air from the cylindrical retainer, rotating a rotary working device installed in the cylindrical retainer, and contacting working protrusion protruding from the working device with the granular material to remove foreign substances and to perform surface-working of the granular material so as to form a rough surface without causing degeneration, denaturation or substantial removal of useful ingredients, wherein the surface-worked granular product has surface characteristics different from raw granular material.

6 Claims, 12 Drawing Sheets

Figure 1:
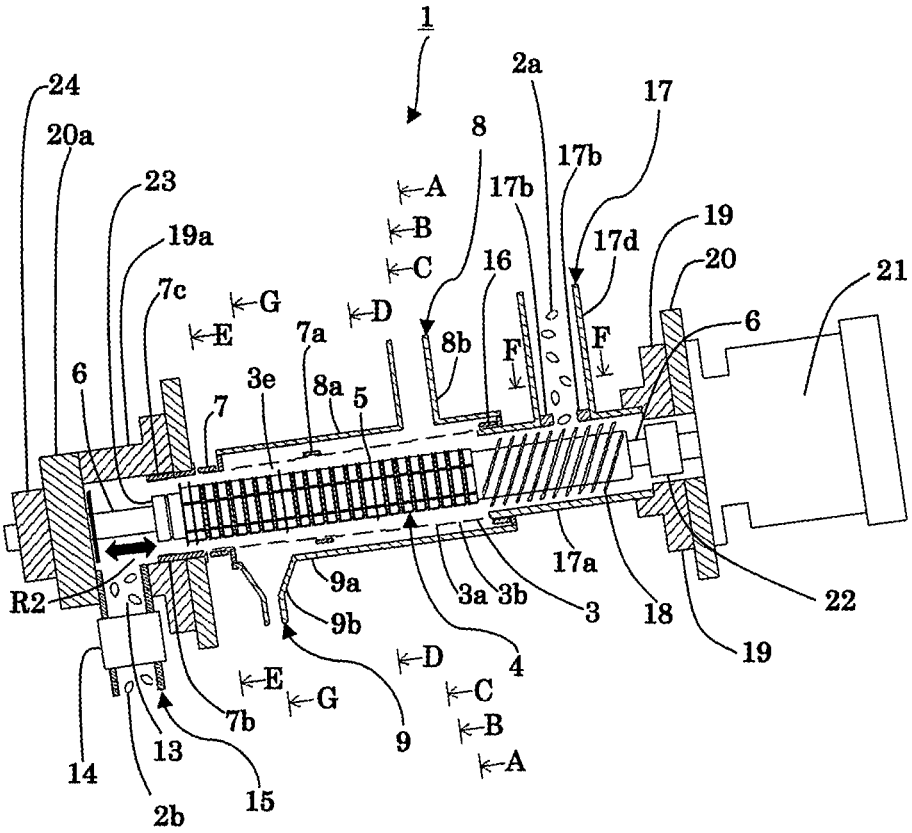

(51) Int. Cl.
*B02B 3/04* (2006.01)
*B02B 3/00* (2006.01)

(56) References Cited

U.S. PATENT DOCUMENTS

| | | | | | |
|---|---|---|---|---|---|
| 4,661,365 | A * | 4/1987 | Malone | B02B 1/04 | 426/481 |
| 4,978,078 | A * | 12/1990 | Vadnay | B02B 3/06 | 241/74 |
| 5,024,148 | A * | 6/1991 | Moses | B02B 3/04 | 99/574 |
| 5,150,844 | A * | 9/1992 | McKie | B02C 13/06 | 241/191 |
| 5,181,457 | A * | 1/1993 | Toshiyuki | A01C 1/00 | 209/154 |
| 5,538,747 | A * | 7/1996 | Mueller | B02B 1/06 | 426/507 |
| 5,598,770 | A * | 2/1997 | Campbell | A23N 17/00 | 99/487 |
| 6,042,863 | A * | 3/2000 | George | A23N 5/002 | 426/481 |
| 6,070,815 | A * | 6/2000 | Miyatake | B02B 3/00 | 241/47 |
| 6,076,454 | A * | 6/2000 | Hagon | B02B 3/12 | 99/519 |
| 6,277,424 | B1 * | 8/2001 | Kwangwaropas | A23N 15/06 | 426/483 |
| 6,322,836 | B1 * | 11/2001 | Rubio | A21D 6/003 | 426/463 |
| 6,327,970 | B1 * | 12/2001 | Kooima | A01D 43/081 | 460/108 |
| 6,776,087 | B1 * | 8/2004 | Amstad | A23N 7/02 | 99/540 |
| 7,302,886 | B2 * | 12/2007 | Hamilton | A23N 5/01 | 99/606 |
| 7,939,325 | B2 * | 5/2011 | Adams, Jr. | A01H 4/001 | 435/440 |
| 10,722,896 | B2 * | 7/2020 | Giguere | B02C 7/13 | |
| 2002/0031596 | A1 * | 3/2002 | Aoto | A23L 7/196 | 426/618 |
| 2003/0015103 | A1 * | 1/2003 | Imura | A23L 7/196 | 99/519 |
| 2009/0068332 | A1 * | 3/2009 | Idowu | A23N 5/00 | 426/483 |
| 2010/0003904 | A1 * | 1/2010 | Duescher | B24B 37/26 | 451/259 |
| 2010/0178852 | A1 * | 7/2010 | Horigane | B02B 3/10 | 451/59 |
| 2011/0003065 | A1 * | 1/2011 | Eugster | B02B 3/00 | 426/648 |
| 2012/0132087 | A1 * | 5/2012 | Chen | B07B 1/24 | 99/617 |
| 2013/0034643 | A1 * | 2/2013 | Turgeman | B02C 18/30 | 426/417 |
| 2013/0067690 | A1 * | 3/2013 | Wedegaertner | B02B 3/10 | 19/41 |
| 2015/0122924 | A1 * | 5/2015 | Kajihara | B02B 5/02 | 241/75 |
| 2017/0239665 | A1 * | 8/2017 | Zhou | A23L 7/197 | |

FOREIGN PATENT DOCUMENTS

| | | | | |
|---|---|---|---|---|
| JP | 55-16895 | | 7/1978 | |
| JP | 5417147 | * | 2/1979 | |
| JP | 127776 | B2 | 6/1984 | |
| JP | 60-22939 | A | 2/1985 | |
| JP | 61177975 | * | 8/1986 | |
| JP | 61181369 | A * | 8/1986 | |
| JP | 4-330203 | A | 11/1992 | |
| JP | 06-099088 | A | 4/1994 | |
| JP | 10-015408 | A | 1/1998 | |
| JP | 2000-354773 | A | 12/2000 | |
| JP | 2001-246272 | A | 9/2001 | |
| JP | 2001-352916 | A | 12/2001 | |
| JP | 2002-159269 | A | 6/2002 | |
| JP | 2003326179 | A | 11/2003 | |
| JP | 2004248608 | A | 9/2004 | |
| JP | 2004283030 | A | 10/2004 | |
| JP | 2005144424 | A * | 6/2005 | B02B 3/02 |
| JP | 2007-209937 | A | 8/2007 | |
| JP | 4849520 | B2 | 8/2007 | |
| JP | 2008-264610 | A | 11/2008 | |
| JP | 2010162473 | A | 7/2010 | |
| JP | 2017-515665 | A | 6/2017 | |
| KR | 10-0664675 | B1 | 1/2007 | |
| KR | 10-1342998 | * | 12/2013 | |
| KR | 101342998 | * | 12/2013 | |

OTHER PUBLICATIONS

Written Opinion with English translation issued in corresponding Japanese Patent Application 2017-181791, dated May 26, 2021 (20 pages).

Decision of Refusal with English translation issued in corresponding Japanese Patent Application 2017-181791, dated Jun. 22, 2021 (23 pages).

Japanese Written Request for Appeal with English Translation submitted in corresponding Japanese Application No. 2017-181791, dated Sep. 8, 2021 (52 pages).

Revised 3rd Edition, Chemical Engineering Dictionary with English translation, Edited by Society of Chemical Engineers, Japan, Issued by Maruzen Kabusikikaisha on Mar. 20, 1986 (11 pages).

Quality labeling standard for brown rice and milled rice with English Translation, enacted on Mar. 31, 2000, Ministry of Agriculture, Forestry and Fisheries Notification No. 515 (5 pages).

Nobunkyo, Food and Agriculture Policy Research Center, Science Of The Rice Plant with English translation, Morphology, vol. One, dated Feb. 15, 2006 (36 pages).

Takamasa Mezaki, Abrasive grain processing of rice and sake brewing with English translation, Journal of the Society of Delicious Technology 14 (2): pp. 7-17, 2016 (34 pages).

Consumer Affairs Agency, Food Labeling Planning Division, Revision of food labeling system for brown rice and milled rice with English translation, dated Jun. 3, 2021 (9 pages).

Akira Horigane, Technical explanation regarding difference between Japanese Application No. 2017-181791 and with English Translation dated Sep. 2, 2021 (8 pages).

Written Opinion issued in corresponding Japanese Patent Application No. 2021-088770, with English translation, dated Jan. 29, 2022 (38 pages).

Notice of Reasons for Refusal (Japanese Office Action) issued in corresponding Japanese Patent Application No. 2021-088770, with English translation, dated Feb. 15, 2022 (14 pages).

Rice Polisher RSF-A100 | Product Information | Tiger Thermos, Rice mill RSF-A100, "Home milling that can be continued every day because it is easy to use. Easily clean and carefully polish the rice." retrieved Jan. 25, 2022, with English translation retrieved Feb. 8, 2022 (10 pages).

Risa Araki et al., Functional evaluation of surface-treated brown rice by human intervention test Research on new brown rice that is good for health and delicious, Journal "Kagaku to Seibutsu" of Japan Society for Bioscience, Biotechnology, and Agrochemistry, vol. 55, No. 5, pp. 345-350 (2017), with English translation (12 pages).

Development of a system for providing surface-treated brown rice and its processed products, Collection of research results of agricultural, forestry and fishery products and food development projects with functionality, Study on Development of Agricultural Products and Foods with Health-promoting benefits, National Agriculture and Food Research Organization, Jan. 31, 2017, pp. 19-27, with English translation (24 pages).

Reconsideration Report by Examiner before Appeal with English translation in corresponding Japanese Application No. 2017-181791, dated Oct. 5, 2021 (13 pages).

(56) References Cited

OTHER PUBLICATIONS

Notice of Reasons for Refusal (Japanese Office Action) with English translation issued in corresponding Japanese Application No. 2021-088770 dated Nov. 30, 2021 (11 pages).
Kuramoto Haru, The brown rice is plump! What is the rice milling machine "RSF-A100" equipped with epoch-making functions? I tried using Tiger's "rice milling machine that can make" small scratches "on brown rice"!, Price.com Magazine, dated Sep. 14, 2016 (31 pages).
Risa Araki et al., An Exploratory Randomized Crossover Trial to Investigate the Palatability of Partially Abraded Brown Rice, Journal of Japan Society of Nutrition and Food Science, vol. 69, No. 5, pp. 249-255 dated Oct. 2016 (8 pages).
Hiroshi Okadome et al., Comparison of Processing Characteristics between Brown Rice and the Partially Abraded Brown Rice Grains, National Food Research Institute, NARO, Kagoshima Prefectural Institute for Agricultural Development, Abstracts of Meeting of the CSSJ, 238th, p. 102, Sep. 2014 (4 pages).
Shuji Kawahara, Development of Abrasion Processing of Wheat Grain and Baking Technology with High-quality Whole Wheat Flour of Hokkaido Noodle Cultivars, Nippon Shokuhin Kogaku Kaishi vol. 60, No. 6, pp. 266-269, 2013 (5 pages).
Decision of Dismissal of Amendment issued in corresponding Japanese Patent Application No. 2021-088770, with English translation, dated Apr. 19, 2022 (20 pages).
Starch digestibility of brown rice and control factors of blood glucose level after ingestion of brown rice, food—its science and technology, No. 55, Japan, National Agriculture and Food Research Organization, Mar. 29, 2017, pp. 19-32, with English translation (34 pages).

* cited by examiner

APPARATUS AND PROCESS FOR PRODUCING SURFACE-WORKED GRANULAR PRODUCT

TECHNICAL FIELD

The present invention relates to an apparatus and a process for producing a surface-worked granular product by removing foreign substances and surface-working granular raw food material originating from a plant seed, for example, a granular cereal, such as wheat, barley, rice, corn or buckwheat, or bean or sesame harvest or other granular material. More specifically, the present invention relates to an apparatus and a process for producing surface-worked granular product by removing foreign substances and surface-working granular raw food material to form a rough surface without causing degeneration, denaturation or substantial removal of useful ingredients.

BACKGROUND TECHNOLOGY

Granular raw food material originating from a plant seed, for example, a granular cereal, such as wheat, barley, rice, corn or buckwheat, or bean or sesame harvest has a tough and/or low water-permeable skin layer in outer layers. In order to use such granular raw food material for food, a polished cereal product obtained by removing the skin layer is provided for food. In case of rice, polished rice or partially polished rice is used for food. In the case using the polished cereal product, many useful ingredients contained in the outer layers including embryo are removed and discarded as a residue. To avert such disadvantages, whole grain such as unprocessed brown rice is recommended to be used for food. However, unprocessed brown rice or the like requires long immersion time and long heating time for cooking due to the low water-permeability of the skin layer, causing cooking to be difficult. The unprocessed brown rice or the like further gives bad texture because the tough skin layer cannot be crushed to remain in the mouth.

Reactivity and permeability of granular material to dispersion medium such as liquid and gas are affected by surface conditions of the granular material. In order to change the reactivity and the permeability of the granular material without chemical modification, surface-treatment of the granular material by scratching the surface to form a rough surface causing changes of specific surface area and affinity is adopted in many fields such as food, industrial raw material and pharmaceuticals. In the conventional surface treatment, however, the surface-treatment is performed to degenerate, denature or substantially remove useful ingredients in the outer layers of the granular material.

Regarding granular cereal material, since a tough and/or low water-permeable skin layer is formed in outer layers, polishing rice, barley or the like is carried out by surface treatment utilizing friction and collision of granular materials during pressurized processing, or grinding with abrasive grains or blade, for removing unnecessary substances on the surface and improving surface characteristics such as water-permeability. In such a conventional method, however, frequency of pulverization of the raw granular material increases and the chemical reaction proceeds due to frictional heat and heat storage so that quality of the product deteriorates.

Patent Document 1 (JPH06-99088A) discloses a general rice polishing method wherein, in a polishing step, raw brown rice is fed with pressure to a gap between an outer cylinder composed of a punching material and a rotating body to polish the rice by milling force generated between the grains and the outer cylinder and contact friction between the grains. In such a method, however, scratches reaching the inner surface of the aleurone layer are formed so that useful components including the surface layer portion are peeled off and the embryo tissues, aleurone layer and other components are removed.

Pressure type or impeller type rice polishers for home use are mainly used for preparing polished rice with a polishing rate of about 10% wherein useful ingredients including the surface layer portion of about 10% of raw material brown rice are peeled off and removed, so that it is difficult to increase hydrophilicity, reactivity and the like at the time of cooking without removing useful ingredients such as the surface layer portion of the raw material brown rice including aleurone layer and embryo. Further, in order to prevent re-adhesion of peeled bran, an additional process is required.

Patent Document 2 (JPH10-15408A) discloses an apparatus for grinding rice in which raw rice grains are pressure-fed to a gap between an outer cylinder provided partially with a grinder and a rotating body provided partially with a brush to polish the rice grains by grinding and brushing. In the apparatus, however, polishing is performed by friction between granules and formed bran adhering to the rice grains is peeled off by brush. Patent Document 2 does not teach grinding rice without denaturation, decomposition or substantial removal of useful material.

Patent Document 3 (JP2007-209937A) teaches a technique slightly grinding surface of raw granular material by a flexible plastic abrader disposed extending radially of a rotary shaft in a cylindrical retainer, wherein the outer layers of each granule are slightly ground and removed by contacting with the flexible plastic abrader. Patent Document 3 does not teach surface-working of granular material while the granular material is floated and fluidized.

These conventional techniques for surface treatment of granular material by removing a part of outer layers is substantially the same as polishing of rice wherein useful ingredients contained in the layers are denatured, decomposed or removed so that whole grain cannot be used.

Patent Document 1: JPH06-99088A
Patent Document 2: JPH10-15408A
Patent Document 3: JP2007-209937A

DISCLOSURE OF THE INVENTION

Problem to be Solved by the Invention

An object of the present invention is to provide an apparatus for producing a surface-worked granular product having surface characteristics different from raw granular material by removing foreign substances and performing surface-working of the granular material so as to form a rough surface without causing degeneration, denaturation or substantial removal of useful ingredients.

Another object of the present invention is to provide a process of producing a surface-worked granular product having surface characteristics different from raw granular material by removing foreign substances and performing surface-work of the granular material so as to form a rough surface without causing degeneration, denaturation or substantial removal of useful ingredients.

A further object of the present invention is to provide a surface-worked granular product obtained by the process and having surface characteristics different from raw granular material.

A different object of the present invention is to provide processed goods comprising the surface-worked granular product.

Means for Solving the Subject

Accordingly, the present invention provides the following apparatus and process to producing surface-worked granular product, surface-worked granular product obtained by the process and processed goods comprising the surface-worked granular product.

(1) An apparatus for producing a surface-worked granular product, comprising a cylindrical retainer having a multiplicity of apertures and a multiplicity of retaining sites for temporarily retaining each granule of granular material circling and traveling along the inner surface of the cylindrical retainer, a rotary working device which is installed to a rotary shaft extending along the central axis of the cylindrical retainer and has a working protrusion protruding from the outer surface of the working device for removing foreign substances and surface-working the granular material so as to forma rough surface by contacting with the granular material, a raw material supply site for supplying raw granular material to the cylindrical retainer, a product takeout site for taking out a surface-worked granular product from the cylindrical retainer, and an occurring dust discharge site for discharging, by suction, occurring dust from upper portion of the cylindrical retainer through the apertures causing to float the granular material.

(2) The apparatus as defined in the above (1), wherein the rotary working device comprises plural working units installed to the rotary shaft in layers, wherein the working unit comprises one or more surface-roughening tools each composed of a disk installed to the rotary shaft and working protrusion protruding radially from the periphery of the disk for surface-roughening by contacting with the granular material fluidized in a passage in the cylindrical retainer, and a releasing/dispersing tool comprising a base portion installed to the rotary shaft, a temporarily storing portion formed around the base portion and a releasing vane extending radially from the base portion for releasing and dispersing the granular material residing in the temporarily storing portion.

(3) The apparatus as defined in the above (1), wherein the apparatus further comprises a crushed material discharge site for discharging crushed material from lower portion of the cylindrical retainer through the apertures.

(4) The apparatus as defined in the above (2), wherein the rotary working device further comprises, in or outside of the working unit, a weir member for controlling flow of the granular material along the inner surface of the cylindrical retainer.

(5) The apparatus as defined in the above (4), wherein the weir member has a combination of convex and concave along the periphery of the weir member for controlling the flow of the granular material.

(6) The apparatus as defined in the above (2), wherein the working unit of the rotary working device comprises plural surface-roughening tools having different heights of periphery which are installed to the rotary shaft in layers so as to form differences in level along the periphery of the rotary working device.

(7) The apparatus as defined in the above (2), wherein each member composing the rotary working device is installed to the rotary shaft loosely so as to allow fluctuating and/or sliding in rotational and/or axial direction.

(8) The apparatus as defined in the above (1), wherein the cylindrical retainer is composed of one or more perforated plates in a cylindrical configuration and has one or more diameter adjustment means for adjusting the diameter of the cylindrical retainer.

(9) The apparatus as defined in the above (8), wherein the plural perforated plates composing the cylindrical retainer have the same or different retaining sites and/or apertures.

(10) The apparatus as defined in the above (1), wherein the raw material supply site comprises a conveyor cylinder connected to the cylindrical retainer and a screw conveyor installed inside of the conveyor cylinder.

(11) The apparatus as defined in the above (1), wherein the product takeout site comprises a sorter for sorting the surface-worked granular product taken out from the cylindrical retainer.

(12) A process of producing a surface-worked granular product, comprising supplying raw granular material to a cylindrical retainer having apertures and retaining sites for temporarily retaining each granule of the granular material circling and traveling along the inner surface of the retainer, floating the granular material by suctioning air from upper portion of the cylindrical retainer through the apertures, rotating a rotary working device installed to a rotary shaft extending along the central axis of the cylindrical retainer, and contacting working protrusion protruding from the outer surface of the working device with the granular material to remove foreign substances and to perform surface-working the granular material so as to form a rough surface.

(13) The process as claimed in claim 12), wherein the raw granular material is granular material having a tough and/or low water-permeable skin layer, and the surface-working is working to form a rough surface by forming irregular and minute flaws and/or scrapes on the skin layer.

(14) The process as defined in the above (13), wherein the surface-worked granular product is produced by using the apparatus as defined in the above (1).

(15) A surface-worked granular product obtained by the process as defined in the above (12).

(16) Processed goods obtained by secondary processing of the surface-worked granular product as defined in the above (15).

In the present invention, the raw granular material to be subjected to surface-working is granular material composed of organic or inorganic substances so long as they can be subjected to such surface-working, which include, without any restriction, granular food raw material such as cereal and other granular material such as biological, organic and chemical particulate material. Among these, suitable objects for surface-working include granular foods originating from grains such as rice, barley, wheat and buckwheat, and seeds of plants such as beans and sesame. In particular, more suitable objects include granular material having a tough and/or low water-permeable skin layer in outer layers, for example, grains such as brown rice, wheat, barley and buckwheat, and corn, beans and sesame. However, granular materials covered with a hardly peelable outer cover (rice hull in the case of rice, wheat hull in the case of wheat, buckwheat chaff in the case of buckwheat etc.) such as unhulled rice and raw buckwheat can also be targeted for surface-working.

Since granular foods originating from grains such as rice, barley, wheat and buckwheat, and seeds of plants such as beans and sesame seeds have tough and/or low water-permeable skin layers, unprocessed brown rice or the like requires long immersion time and long heating time for cooking, causing cooking to be difficult, and further gives bad oral texture because the tough skin layer cannot be crushed to remain in the mouth. In addition, when unprocessed wheat, buckwheat, brown rice and the like are milled for use, hardly breakable skin layers are not pulverized to remain as a coarse fraction, which may result in inferior processing properties, bad oral texture and so on.

The surface-working in the present invention is working to remove foreign substances adhering to the surface of granular material and to give surface characteristics different from raw granular material without causing degeneration, denaturation or substantial removal of useful ingredients. More specifically, the surface-working is performed by rotating a rotary working device in a cylindrical retainer in a state where granular material is floated, to forma large number of irregular and minute flaws and/or scrapes on the surface of the granular material so that a rough surface is formed and surface characteristics different from the raw granular material such as breakability, permeability, wettability and the like of the outer layers are imparted.

The surface-worked granular product according to the present invention is obtained by such a surface-working to remove foreign substances such as useless ingredients, soil, bacteria or the like adhering to the surface of the raw granular material and to impart surface characteristics different from the raw granular material so that characteristics of the granular material such as milling aptitude, cooking performance, sanitation, nutrition, texture or the like are improved.

In the process of producing a surface-worked granular product according to the present invention, raw granular material is supplied to a cylindrical retainer having apertures and retaining sites for temporarily retaining each granule of the granular material to circle and travel along the inner surface of the retainer. Here, in a state where the granular material is floated by suctioning air from the upper portion of the cylindrical retainer through the apertures, a rotary working device installed to a rotary shaft extending along the central axis of the cylindrical retainer is rotated so that a multiplicity of working protrusions protruding from the outer surface of the working device contact with the granular material to remove foreign substances and to perform surface-working of the granular material so as to form a rough surface. Thereby, a surface-worked granular product having surface characteristics different from the raw granular material can be produced without causing degeneration, denaturation or substantial removal of useful ingredients.

An essential matter here is to perform surface-working of the granular material as fluidized by rotating the rotary working device in a state where the granular material is floated. In a conventional process for surface treatment of granular material such as polishing rice, grinding rice or the like, surface treatment is carried out in such a manner that raw granular material such as raw brawn rice or the like is fed with pressure by rotating a rotary body or the like, wherein there occur peeling off of outer layers and partial loss of tissue because values of frictional resistance and impact between granules or between granules and rotary body are high levels. On the contrary, in the process according to the present invention wherein the granular material is fluidized by rotating the rotary working device in a state where the granular material is floated, the granular material contacts with the rotary working device in a state where values of frictional resistance, impact, and heat generation between granules or between granules and rotary body are low levels. Accordingly, irregular and minute flaws and/or scrapes are formed on the skin layer in the process according to the present invention, so that a rough surface is formed and surface characteristics different from the raw granular material such as breakability, permeability, wettability and the like of the outer layers are imparted.

In the case that the raw granular material has a tough and/or low water-permeable skin layer in outer layers as raw granular food material originating from a plant seed, for example, a granular cereal, such as brown rice, wheat, barley, corn or buckwheat, or a bean or sesame, surface-working is performed to form a rough surface by forming irregular and minute flaws and/or scrapes on the skin layer and to impart surface characteristics such as breakability, permeability, wettability and the like which are different from raw granular material. In the case that granular materials are covered with hardly peelable outer cover (rice hull in the case of rice, wheat hull in the case of wheat, buckwheat chaff in the case of buckwheat etc.) such as unhulled rice and raw buckwheat, surface-working is performed as a primary treatment to form a rough surface on the outer layers such as epicarp so as to give physical characteristics to facilitate peeling and removal of the epicarp by impact received in a epicarp removal step as a secondary treatment.

The apparatus for producing a surface-worked granular product according to the present invention is provided with a cylindrical retainer having a multiplicity of apertures and a multiplicity of retaining sites for temporarily retaining each granule of granular material circling and traveling along the inner surface of the cylindrical retainer, a rotary working device which is installed to a rotary shaft extending along the central axis of the cylindrical retainer and has a multiplicity of working protrusions protruding from the outer surface of the working device for removing foreign substances and surface-working the granular material so as to form a rough surface by contacting with the granular material, a raw material supply site for supplying raw granular material to the cylindrical retainer, a product take-out site for taking out a surface-worked granular product from the cylindrical retainer, and an occurring dust discharge site for discharging, by suction, occurring dust from upper portion of the cylindrical retainer through the apertures causing to float the granular material. Preferably, the apparatus is further provided with a crushed material discharge site for discharging crushed material from lower portion of the cylindrical retainer through the apertures. Using these apparatus, a surface-worked granular product is produced.

The retaining sites provided in the cylindrical retainer are composed for temporarily retaining each granule of the granular material circling and traveling along the inner surface of the cylindrical retainer to generate resistance to the circling and traveling granular material so that surface-working of the granular material is accelerated. The apertures, which are provided for ventilation mainly, can be provided for the retaining sites concurrently. In this case, an aperture has smaller diameter than the size of the each granule so as to retain the granule wherein opening edge of the aperture acts as a retaining site. Apart of the opening edge may protrude inward at a location downstream side of the circling and traveling granular material to increase retaining ability so that hitting power and impact are caught with the protruding portion to increase surface-working ability. Shape and size of the aperture can be selected optionally according to shape and size of the granule so that the granule does not pass through. For example, in case of brown rice, an elliptical or oval aperture is usually adopted while a circular aperture may be adopted. A protrusion protruding from inner surface of the cylindrical retainer apart from apertures may be provided as a retaining site. Shape, size or the like of the retaining site and the aperture may be varied to meet with function, operation or others at the portion of the cylindrical retainer. For instance, a retaining site and an aperture are composed, at most portions, to have high retaining ability in order to increase resistance to the circling and traveling granular material, while large apertures are provided at an occurring dust discharge site in order to facilitate passing through of air and occurring dust, or increased number of apertures are provided at a crushed material discharge site in order to facilitate passing through of a crushed material. Surface-working of the granular material by a rotary working device is performed by generation of resistance to circling and traveling granular material when the granular material is temporarily retained with or removed from the retaining sites.

The cylindrical retainer is formed in a cylindrical configuration from one or more perforated plates and may be provided with one or more diameter adjustment means which are preferably operated from outside to adjust the diameter of the cylindrical retainer. By adjusting the diameter of the cylindrical retainer, size of passage of the granular material which is formed inside the cylindrical retainer is adjusted so that surface-working rate of granular material is adjusted. The cylindrical retainer may be composed from plural perforated plates overlapping slidably so as to facilitate adjustment of size of the cylindrical retainer, preferably being composed so as to adjust the diameter of the cylindrical retainer by adding compressive load from outside. The plural perforated plates composing the cylindrical retainer may have the same or different retaining sites and/or apertures. The cylindrical retainer may be set in any direction, for instance, upright or horizontal direction. In case of upright direction, traveling direction of the granular material may be upward or downward. The cylindrical retainer is preferably set in horizontal direction basically, more preferably set in horizontal direction with slight inclination because gravity is utilized for traveling of the granular material.

A rotary working device provided in the cylindrical retainer is installed to a rotary shaft extending along the central axis of the cylindrical retainer so as to rotate. The rotary working device is provided with a multiplicity of working protrusions protruding from the outer surface of the working device so as to contact with the granular material to remove foreign substances and to perform surface-working of the granular material by rotation of the rotary working device. The rotary working device preferably comprises plural working units installed to the rotary shaft in layers, and the working unit preferably comprises one or more surface-roughening tools and a releasing/dispersing tool installed to the rotary shaft in layers.

The surface-roughening tool is composed of a disk, preferably a circular disk installed to the rotary shaft and a working protrusion protruding radially from the periphery of the disk, wherein the working protrusion contacts, by rotation of the surface-roughening tool, with the granular material fluidized in a passage between the cylindrical retainer and the rotary working device to perform surface-roughening.

The working protrusion may have an arbitrary shape decided according to conditions of the surface-working, such as flat plate shape, curved piece shape, saw tooth shape, nail shape, or the like having a width corresponding to the thickness of the disk and protruding in the radial direction or toward the front or rear of the rotation. Preferable surface-roughening tool is provided with a working protrusion protruding toward the rear of the rotation, more preferably protruding toward the rear of the rotation in a curved shape so that the front surface of the rotation forms convex because the impact on the granular material can be reduced, dispersed and uniformized. When a rotary working device having such a working protrusion is rotated to contact with the granular material as floated and fluidized in a cylindrical retainer, resistance to rotation of the rotary working device is low so that crushing of a granule and peeling of the surface is prevented to form a large number of irregular and minute flaws and/or scrapes on the surface of the granular material whereby a rough surface is formed. It is preferable that sharp edges are formed at both sides of the edge portions of the working protrusion to contact with the granular material, so that minute flaws and/or scrapes are formed in the surface layer portion of the granular material. As surface-working is also performed at the retaining site of the cylindrical retainer by rotation of the rotary working device, the retaining site is preferably formed, as similarly to the working protrusion, so as to disperse the impact and to enable performing fine surface-working. In the case where plural surface-roughening tools are provided in the working unit, plural surface-roughening tools having different heights of periphery are preferably stacked to form differences in level along the periphery of the rotary working device to facilitate surface-working of irregular-shaped portions such as groove of wheat. A working protrusion having sharp edges can facilitate surface-working of irregular-shaped portions similarly. The thickness of the surface-roughening tool is about 0.1 to 2.5 times, preferably about 0.1 to 2 times of the short diameter of the granular material, and the interval between the working protrusions is about 0.1 to 1.5 times, preferably about 0.1 to 1 time of the short diameter of the granular material.

A releasing/dispersing tool is provided on the downstream side of the working unit and has a releasing vane extending radially from a base portion installed to the rotary shaft to release and to disperse the granular material residing in a temporarily storing portion formed around the base portion, toward the inner surface of the cylindrical retainer. The temporarily storing portion is formed in a shape and size such that at least one granular material flows in from a passage between a cylindrical retainer and a surface-roughening tool on the upstream side and is temporarily stored therein. The releasing vane is formed in an agitation blade shape which pushes out the granular material in the temporarily storing portion toward the inner peripheral surface of the cylindrical retainer by rotation of the releasing/dispersing tool. The releasing vane is larger than a working protrusion of the surface-roughening tool and may have, as similar to a working protrusion, an arbitrary shape decided according to conditions of the releasing or dispersing, such as plate shape, curved piece shape, saw tooth shape, nail shape, or the like protruding in the radial direction or towards the front or rear of the rotation. Preferable releasing/dispersing tool is provided with a releasing vane extending toward the rear of the rotation, more preferably protruding toward the rear of the rotation in a curved shape so that the front surface of the rotation forms convex because the impact on the granular material can be reduced and uniformized.

The working unit is composed of one or more surface-roughening tools and a releasing/dispersing tool stacked while plural working units are stacked repeatedly to form a rotary working device, by which surface-roughening by surface-roughening tool and releasing and/or dispersing by a releasing/dispersing tool are repeated. One releasing/dispersing tool is provided on the downstream side of a working unit, while the surface-roughening tool is not limited to one, and plural surface-roughening tools may be provided. A rotary working device provided with plural surface-roughening tools having different heights of periphery are stacked to form differences in level is suitable for surface-working of irregular-shaped portions such as groove of wheat, while plural surface-roughening tools having the same heights may be stacked and further a spacer having no working protrusion may be stacked between plural surface-roughening tools.

The rotary working device is preferably provided, in or outside of the working unit, with a weir member for controlling flow of the granular material along the inner surface of the cylindrical retainer wherein a weir member having a combination of convex and concave along the periphery of the weir member is preferable for controlling the flow of the granular material. It is preferable that the weir member has a petal shape in which convex and concave are uniformly dispersed in the outer peripheral portion, while the weir member may be formed in any shape such as a circle or an ellipse. Since the weir member is provided to equalize the flow rate of the granular material, the weir member is preferably stacked in a dispersed manner in the longitudinal direction inside the cylindrical retainer, and further preferably stacked in the most downstream portion, despite that it is not required to be provided in each working unit.

Each member composing the rotary working device is preferably installed to a rotary shaft loosely so as to allow fluctuating or sliding in rotational and/or axial direction so that 1) impact on the granular material by each member of the rotary working device is reduced, 2) crushing of a granule and peeling of the surface are prevented and 3) a large number of irregular and minute flaws and/or scrapes are formed on the surface of the granular material to form a rough surface. In order to allow fluctuating or sliding in rotational and/or axial direction, the member composing the rotary working device is installed to the rotary shaft loosely so as to form slight gaps between the member and the rotary shaft and between the member and engaging tool (for example, key—groove) to absorb impact. The end portion of the rotary working device may be fixed by a fixing tool composed of double nuts and a spring washer or the like to form slight gaps in the axial direction.

The raw material supply site is provided with a conveyor cylinder connected to the cylindrical retainer and a screw conveyor installed inside of the conveyor cylinder so as to feed raw granular material to the starting end portion of the cylindrical retainer. For supplying raw granular material in an amount suitable for the surface-working to the passage between the cylindrical retainer and the rotary working device, a screw conveyor having a screw installed on the outer circumferential surface of a rotary body having a shape and size corresponding to the rotary working device is provided in the conveyor cylinder having a shape and size nearly corresponding to the cylindrical retainer and connected to the cylindrical retainer. In order to stabilize the supply amount of the raw granular material, the raw material supply site is provided with a flow rate adjusting device such as a rotary valve or the like, and the conveyor cylinder is provided with a stabilizing plate for stabilizing the supply thickness of raw granular material on the upper side of the screw conveyer.

An occurring dust discharge site is provided, in the upper part of the cylindrical retainer, with an occurring dust collector covering a number of the apertures and connected to a suction device such as an external bag filter or the like, so that, by sucking from the occurring dust collector through the covered apertures, the granular material in the cylindrical retainer is floated to discharge out occurring dust including peeled fine foreign substances. The occurring dust discharge site is formed, by air cooling, so as to prevent heat generation and heat accumulation in the cylindrical retainer so that degeneration, alteration and the like of the granular material are prevented.

A crushed material discharge site is provided, in the lower part of the cylindrical retainer, with a crushed material receiver covering a number of the apertures, so that crushed material generated by surface-working is collected to the crushed material receiver through the covered apertures and discharged out of the cylindrical retainer.

The product takeout site is formed so as to take out a granular product from the end portion of the cylindrical retainer. The product takeout site may be provided with a sorter for sorting the surface-worked granular product taken out from the cylindrical retainer. The sorter may work to remove foreign substances, broken material or the like. In the case that a magnetic material is used as a constituent material of the apparatus, a magnetic separator is used as the sorter to remove the fragments as foreign substances. In addition, sorting with electromagnetic waves such as visible light, sorting with a sieve, sorting with wind selection or the like may be adopted.

A process of producing a surface-worked granular product using the apparatus described above is carried out by supplying raw granular material to the cylindrical retainer, while the granular material is floated by suctioning air through the apertures and the rotary working device is rotated to fluidize the granular material and to perform surface-working. The raw granular material supplied from the raw material supply site enters to a passage formed between a rotary working device and inner surface of the cylindrical retainer, then circles and travels along the inner surface of the retainer, while a part of the raw material is retained temporarily with the retaining sites of the rotary retainer and dispersed by repulsive power. By rotation of the rotary working device, working protrusions protruding from the outer surface of the working device contacts with the granular material fluidized in the passage to remove foreign substances and to perform surface-working of the granular material so as to form a rough surface. As the raw granular material to be supplied, an air-dried material and/or moisture controlled material may be used. The surface-working is usually carried out in a dry process, while the moisture content of the granular material may be adjusted by spraying mist.

Granular material, traveling in the passage between the cylindrical retainer and the surface-roughening tool, enters into the temporarily storing portion of the releasing/dispersing tool and is then released by a releasing vane extending radially from the base portion toward the inner surface of the retainer to be dispersed. The granular material, traveling in the passage between the cylindrical retainer and the rotary working device, tends to form a laminar flow in the region where the granular material contacts with the surface-roughening tool, while the granular material is released and dispersed by a releasing vane to become a mixed flow in the region where the granular material contacts with the releasing/dispersing tool. These operations are repeated by each working unit, whereby the granular material is uniformized and the fluidized state is maintained.

The flow of the granular material along the inner circumferential surface of the cylindrical retainer is controlled by the weir member provided inside or outside the working unit so that the residence time of the granular material becomes longer and the flow rate of the granular material passing through the passage is adjusted whereby uniform surface-working is performed. In the case where the weir member has a combination of convex and concave along the periphery of the weir member, the flow of the granular material is controlled at the convex portion while the granular material moves over the concave portion. In the case where the weir member is circular, the flow of the granular material is controlled around the circumference while controlled at the major axis portion in the case of ellipse.

In the case that each member composing the rotary working device is installed to the rotary shaft loosely so as to allow fluctuating or sliding in rotational and/or axial direction, impact given to the granular material by each member of the rotary working device is further reduced so that crushing of a granule and peeling of the surface are prevented and a large number of irregular and minute flaws and/or scrapes are formed on the surface of the granular material to form a rough surface. At the start of operation, it is desirable to prevent the occurrence of abnormal vibration by performing trapezoidal control for increasing rotation of the power unit gradually with inverter control so as to maintain the dynamic balance.

When the cylindrical retainer is provided with a diameter adjustment means, diameter of the cylindrical retainer can be adjusted by operation from outside. By adjusting the diameter, size of passage formed inside the cylindrical retainer is adjusted so that surface-working rate of granular material can be adjusted. When the cylindrical retainer is composed from plural perforated plates overlapping slidably, adjustment of size of the cylindrical retainer becomes easier.

At the occurring dust discharge site, by sucking from the upper portion of the cylindrical retainer through the apertures, the granular material is floated, and peeled fine foreign substances and occurring dust are collected by the occurring dust collector and then discharged outside whereby redeposit of the occurring dust to the granular material, heat generation, heat storage and the like are prevented. When the rotary working device is rotated in a state where the granular material is floated, values of friction, impact, contact resistance and the like between granules or between granules and rotary body are low levels, so that irregular and minute flaws and/or scrapes are formed on the skin layer whereby a rough surface is formed and surface characteristics different from raw granular material are imparted.

In the crushed material discharge site, crushed material is taken out from lower portion of the cylindrical retainer through the apertures to a crushed material receiver, together with heavy foreign substances, broken structure of the granular material and the like, and then discharged out of the cylindrical retainer.

In the product takeout site, a granular product is taken out from the end portion of the cylindrical retainer. In the case that the product takeout site is provided with a sorter, a surface-worked granular product taken out from the cylindrical retainer is sorted so that foreign substances, defective material and the like can be removed.

The surface-worked granular material according to the present invention produced in the above process is the granular product which has surface characteristics different from that of the raw granular material and contains substantially the same useful ingredients such as proteins, lipids, vitamins, enzymes, etc. as contained in raw granular material without degeneration, denaturation, deactivation or substantial removal, while foreign substances attached to the raw granular material are removed. Here, some of useful ingredients such as γ-aminobutyric acid and the like increase compared with the raw granular material by enzyme activity retained in the product granular material. Such surface-worked granular material has a rough surface constituted from a large number of irregular and minute flaws and/or scrapes which impart surface characteristics of the outer layers different from the raw granular material such as breakability, permeability, wettability and the like, so that such characteristics as milling aptitude, cooking performance, sanitation, nutrition, texture and the like are improved.

In the case of surface-worked granular material obtained from raw granular food material originating from a plant seed such as a granular cereal, a rough surface caused by a large number of irregular and minute flaws and/or scrapes are formed on the tough and/or low water-permeable skin layer so as to impart the different surface characteristics such as breakability, permeability, wettability and the like, whereby such characteristics as milling aptitude, cooking performance, sanitation, nutrition, texture and the like are improved. In the case of surface-worked brown rice, useful ingredients such as skin layer, aleurone layer, embryo and the like are not removed and the appearance is similar to raw brown rice, while the water absorbency is so high that cooking can be possible by a short time of immersion. A large number of minute flaws and/or scrapes on the skin layer expand due to increase in the turgor pressure of the endosperm portion during rice cooking to generate a large number of cracks in wide area decreasing coarse skin layer fractions so that an uncomfortable feeling by the coarse skin layer fraction in mouth is reduced to give good oral texture like cooked polished rice. In milling prior to cooking of wheat, buckwheat or the like, crushing starts from the minute flaws and/or scrapes in the skin layer so that the tough skin layer becomes a fine crushed material which disperses in the powdered material of other parts.

The present invention is widely applied not only to surface-working of granular material for cooking, for example, various brown rice such as ordinary cooking rice and glutinous rice, but also as a pre-milling technology for wheat such as bread wheat, noodle wheat or the like, barley, glutinous barley, buckwheat and so on. When the surface-working technology is used for rice, wheat, barley and other granular material, excellent food materials including whole grain flour, rich in dietary fiber, vitamins, various steryl ferulates (γ-oryzanol), or the like, and excellent in cooking performance, sanitation, nutrition and texture can be produced so that high-quality secondary processed products with high nutritional value can be manufactured.

The processed goods of the surface-worked granular material according to the present invention are obtained by secondary processing such as milling; cooking and the like of the surface-worked granular material produced in the process explained above. The processed goods have specific characteristics which appeared as new characteristics by the secondary processing of the surface-treated granular material. In the case that the secondary processing is milling, a powder product having improved dispersibility is obtained in which the tough skin layer portion is finely pulverized to disperse in the powdered material of other parts including albumen. In the case that the secondary processing is cooking, cooked foods excellent in appearance, flavor, texture and the like can be produced due to the improved characteristics of the surface-treated granular material and the secondary processed powder, such as water absorbability, cooking performance, dispersibility and the like.

In the case of brown rice, enzymatic activities of embryo and aleurone layer are enhanced by infiltration of moisture so that various metabolic products are produced. In commercially available germinated brown rice, γ-aminobutyric acid is enriched by immersion of brown rice, while enzymatic activity is lost by high temperature treatment to prevent bacterial growth for commercializing. Since the surface-worked brown rice according to the present invention retains embryo and an aleurone layer similarly to unprocessed brown rice and is not subjected to a high-temperature treatment, enzymatic activities of embryo and aleurone layer are enhanced by immersion in secondary processing to increase metabolic products such as γ-aminobutyric acid or the like.

Inventive Effect

In the process of producing a surface-worked granular product according to the present invention, by performing surface-working of granular material by rotating a rotary working device in a cylindrical retainer in a state where the granular material is floated, foreign substances adhering to the surface of granular material are removed, and a large number of irregular and minute flaws and/or scrapes are formed on the surface of the granular material to forma rough surface so that a surface-worked granular product having surface characteristics different from raw granular material such as breakability, permeability, wettability and the like of the outer layers can be produced without causing degeneration, denaturation or substantial removal of useful ingredients.

Since the apparatus for producing a surface-worked granular product according to the present invention is provided with a cylindrical retainer having a multiplicity of apertures and a multiplicity of retaining sites, a rotary working device for removing foreign substances and surface-working by contacting with the granular material and an occurring dust discharge site for discharging occurring dust from the cylindrical retainer causing to float the granular material, foreign substances adhering to the surface of granular material are removed and a large number of irregular and minute flaws and/or scrapes are formed on the surface of the granular material to form a rough surface so that a surface-worked granular product having surface characteristics different from raw granular material such as breakability, permeability, wettability and the like of the outer layers can be produced without causing degeneration, denaturation or substantial removal of useful ingredients, by a simple apparatus and operation without applying excessive pressure or temperature.

The surface-worked granular product according to the present invention is a granular product obtained by the process and apparatus above in which foreign substances adhering to the surface of raw granular material are removed and surface characteristics different from raw granular material are imparted without causing degeneration, denaturation or substantial removal of useful ingredients.

The processed goods according to the present invention is obtained by secondary processing of the surface-worked granular product and has specific characteristics which are embodied as new characteristics by secondary processing from the characteristics imparted to the surface-treated granular material. In the case of surface-treated granular material receiving no heat treatment, biologically active substances such as γ-aminobutyric acid are enriched by enzymes by immersion in secondary processing, so that cooked products imparted with new added value can be obtained.

BRIEF EXPLANATION OF THE APPENDED DRAWING

FIG. 1: A vertical sectional view of the apparatus for producing surface-treated granular product of one mode of embodiment.

Figure 2:
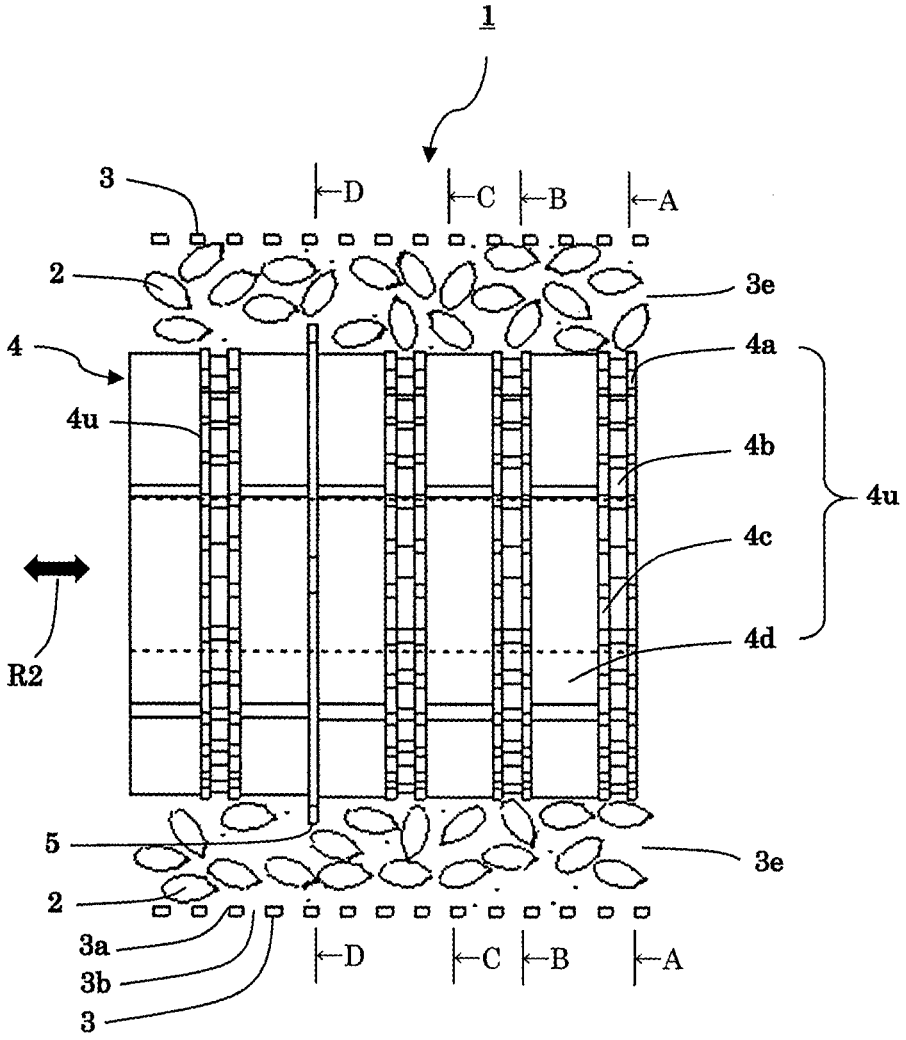

FIG. 2: An enlarged sectional view of a part of FIG. 1.

Figure 3:
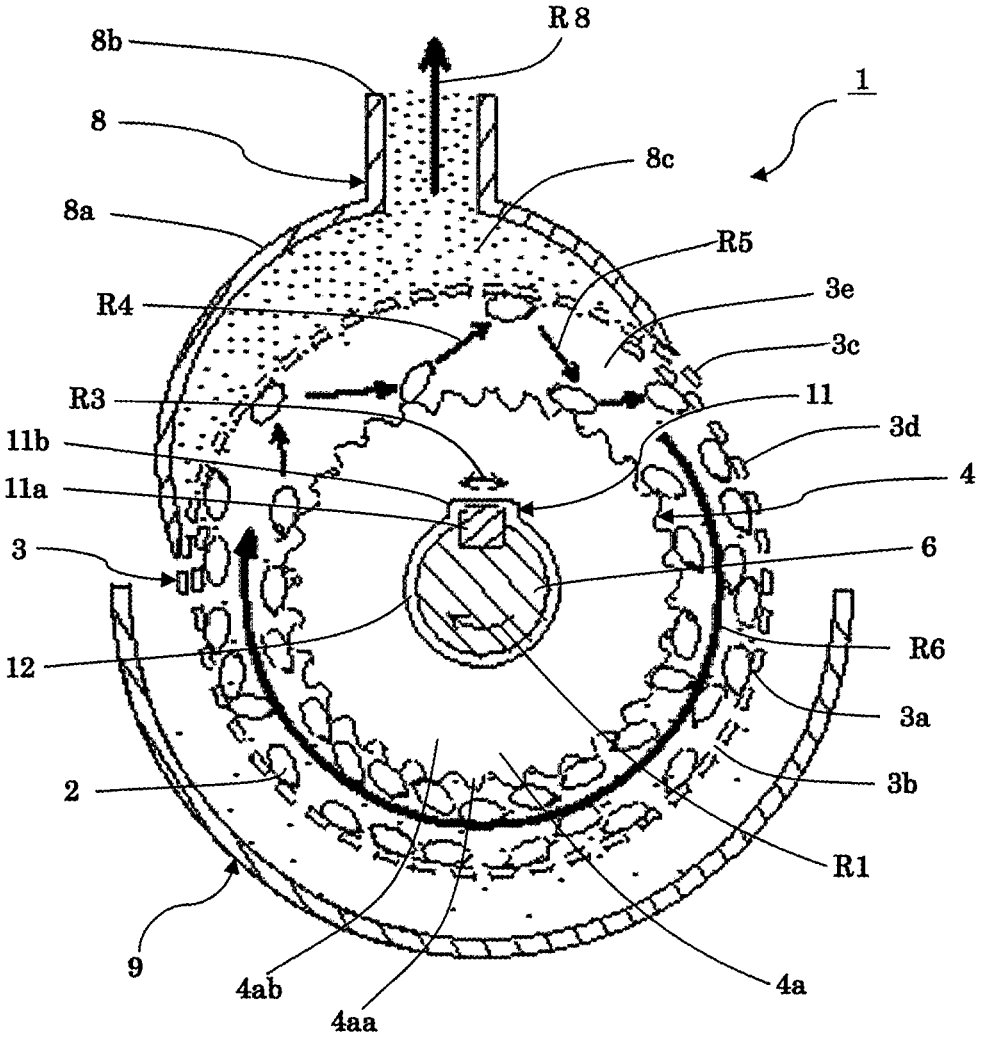

FIG. 3: A cross-sectional view taken along lines A-A of FIG. 1 and FIG. 2.

Figure 4:
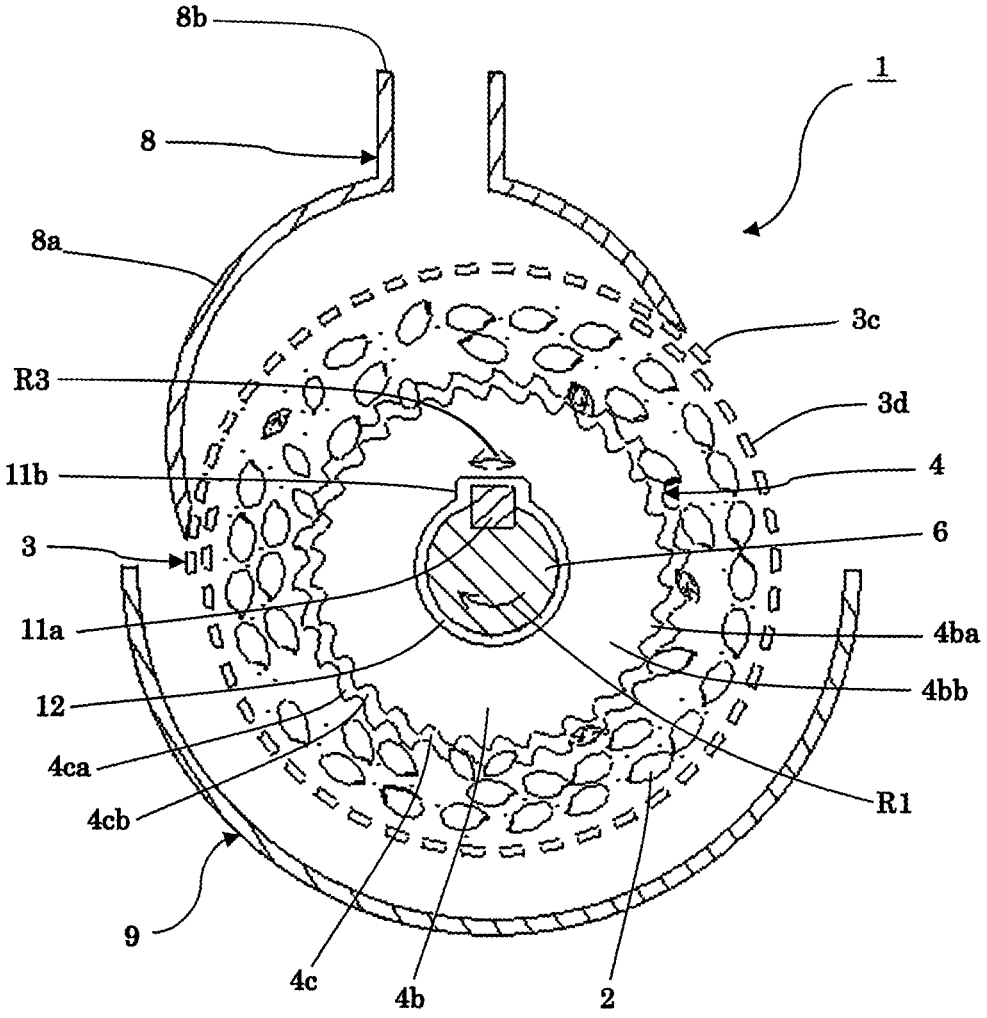

FIG. 4: A cross-sectional view taken along lines B-B of FIG. 1 and FIG. 2.

Figure 5:
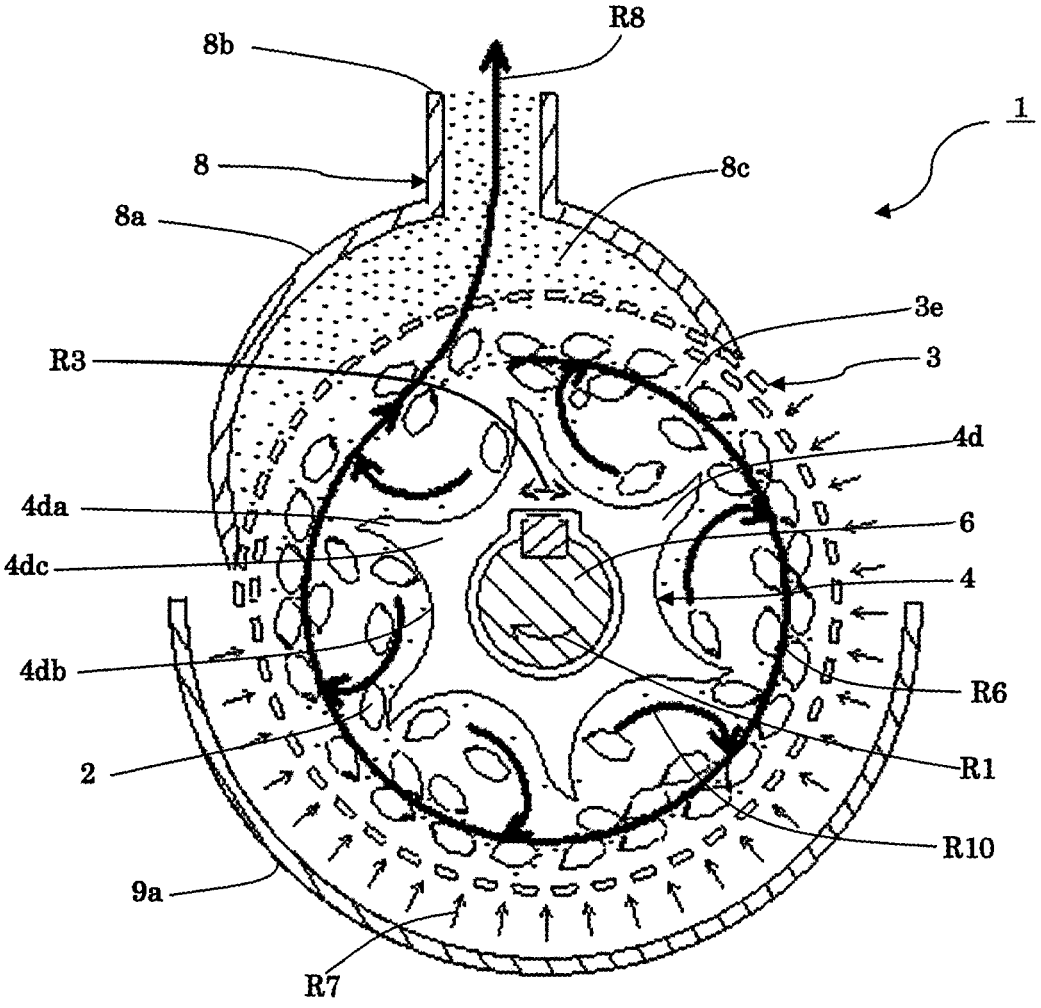

FIG. 5: A cross-sectional view taken along lines C-C of FIG. 1 and FIG. 2.

Figure 6:
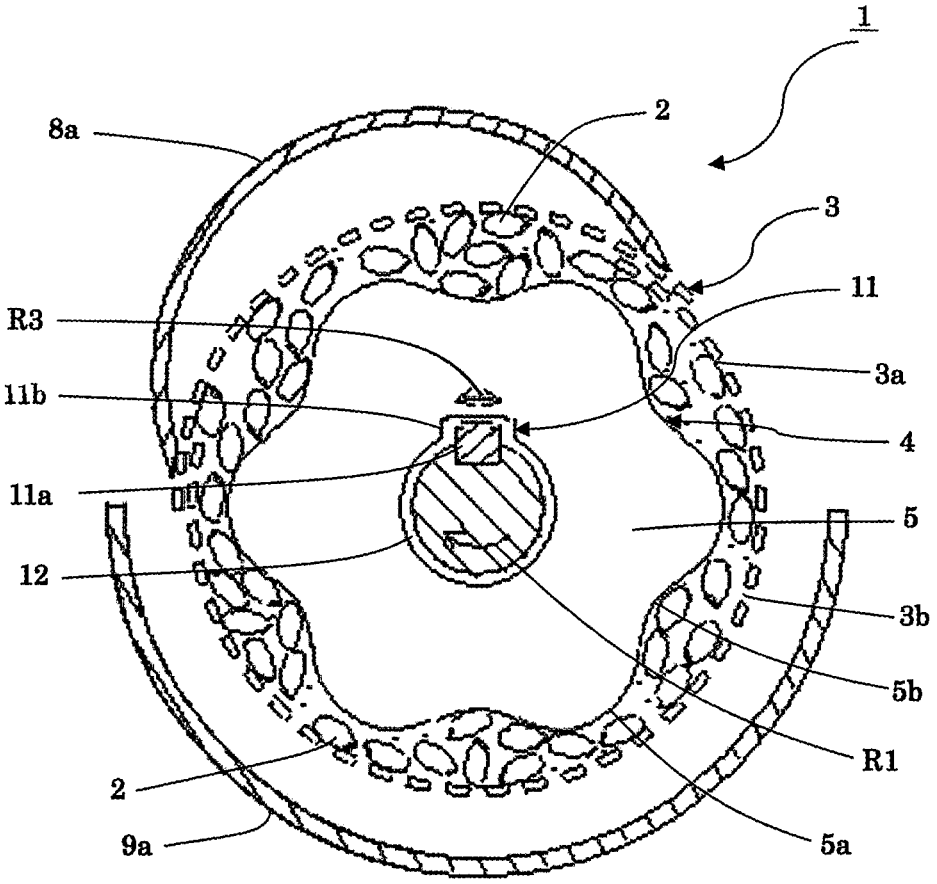

FIG. 6: A cross-sectional view taken along lines D-D of FIG. 1 and FIG. 2.

Figure 7:
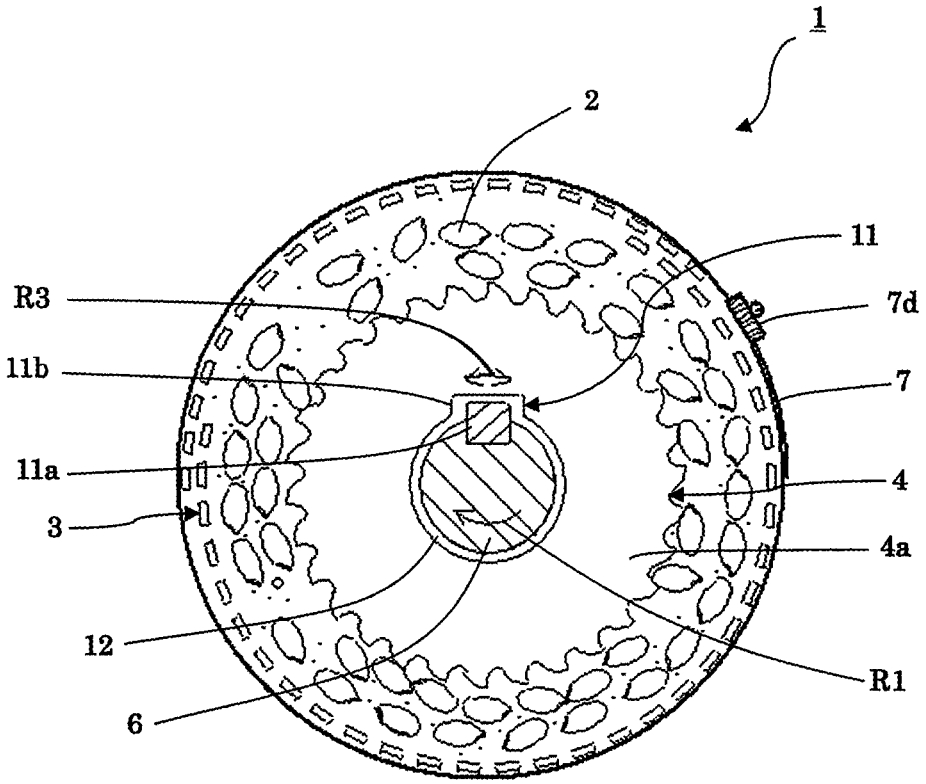

FIG. 7: A cross-sectional view taken along line E-E of FIG. 1.

Figure 8:
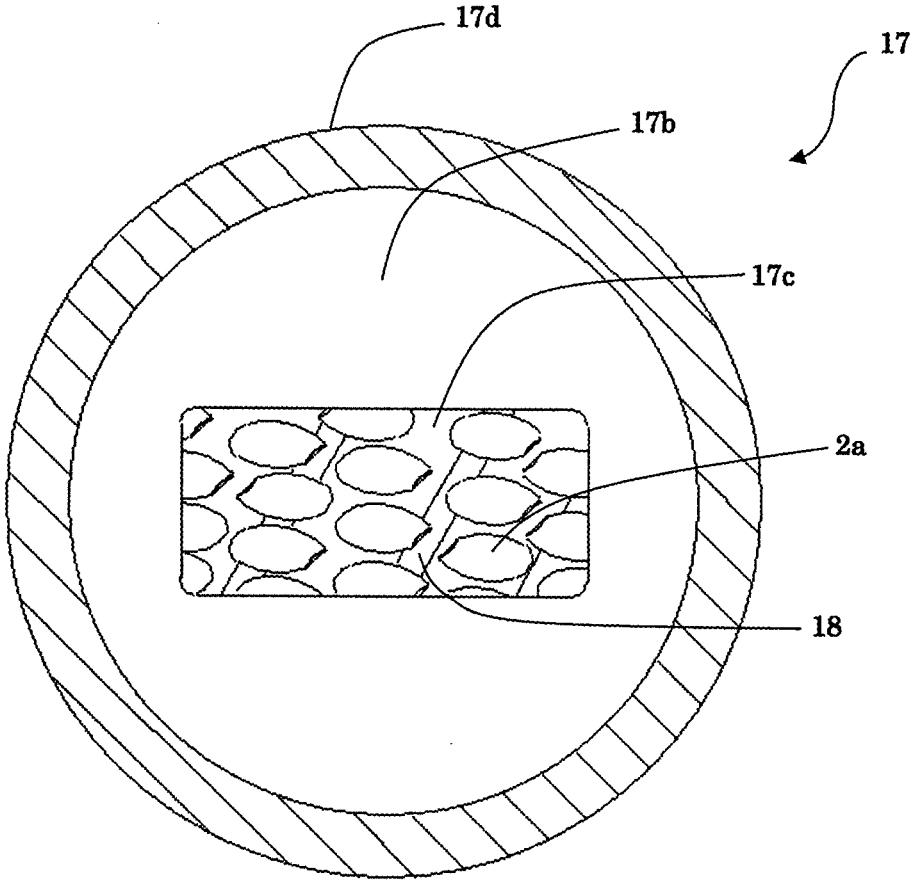

FIG. 8: A cross-sectional view taken along line F-F of FIG. 1.

Figure 9:
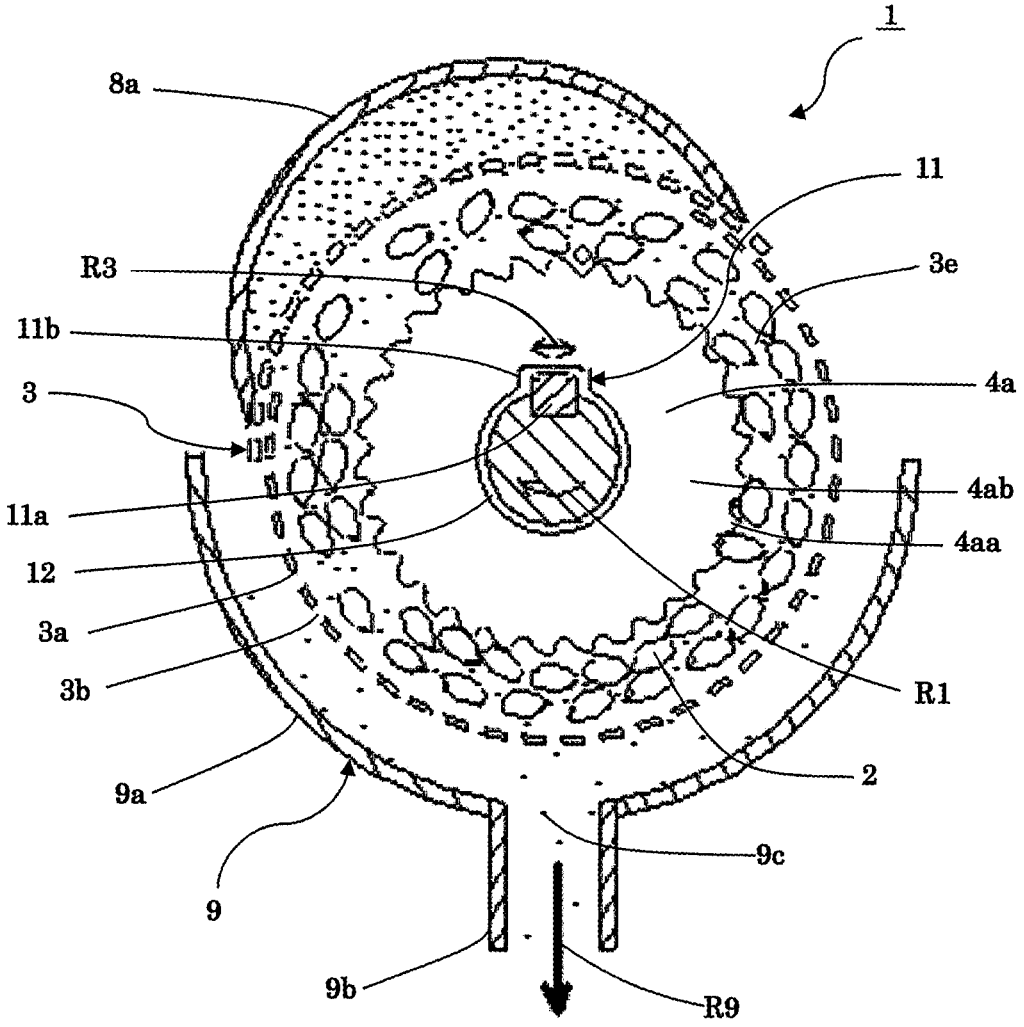

FIG. 9: A cross-sectional view taken along line G-G of FIG. 1.

Figure 10:
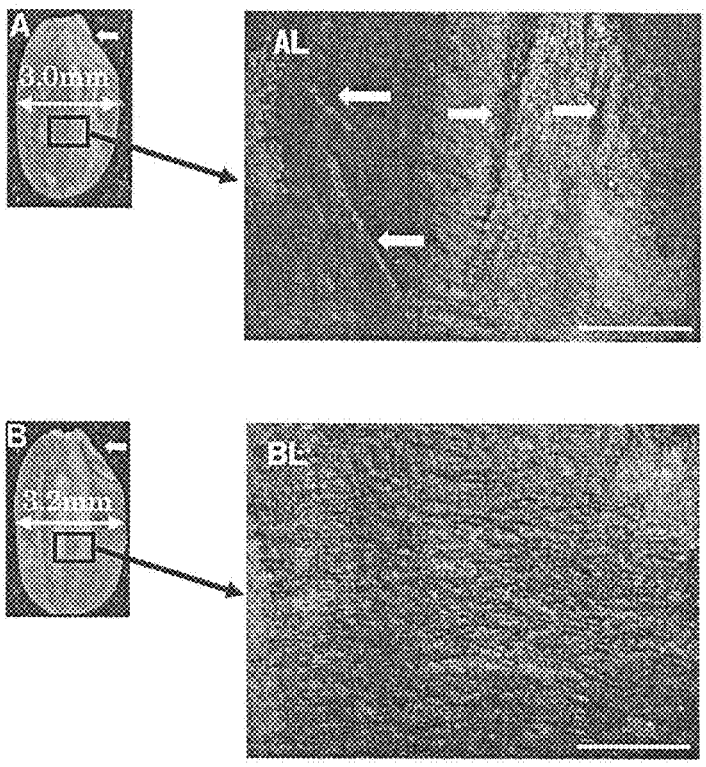

FIG. 10: A and B are comparative photographs of surface-worked brown rice and raw brown rice in Example 1, and AL and BL are magnified photographs thereof, respectively.

Figure 11:
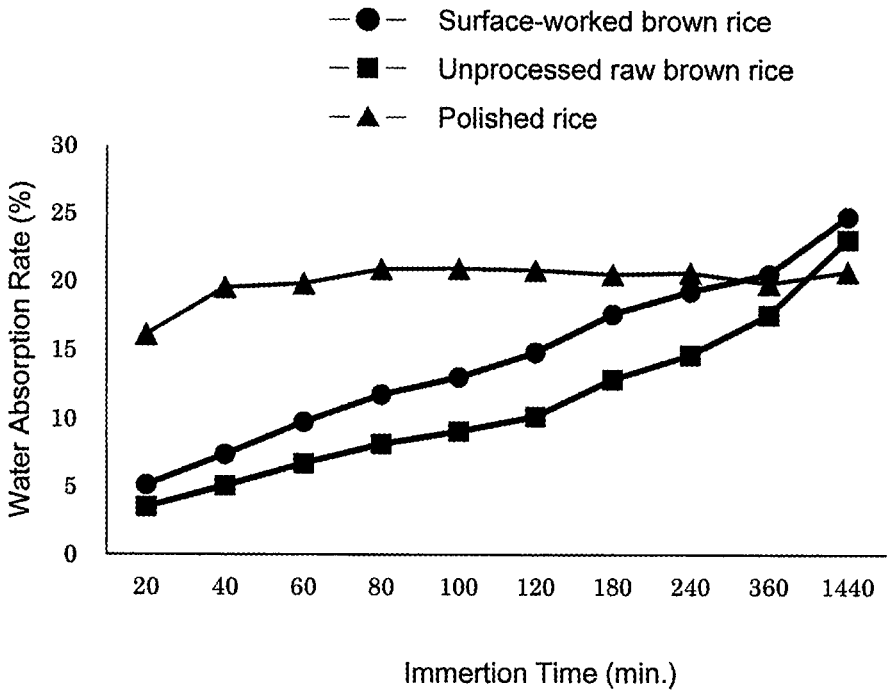

FIG. 11: A graph showing variations by time of the water absorption rates of surface-worked brown rice, unprocessed raw brown rice and polished rice in Example 1.

Figure 12:
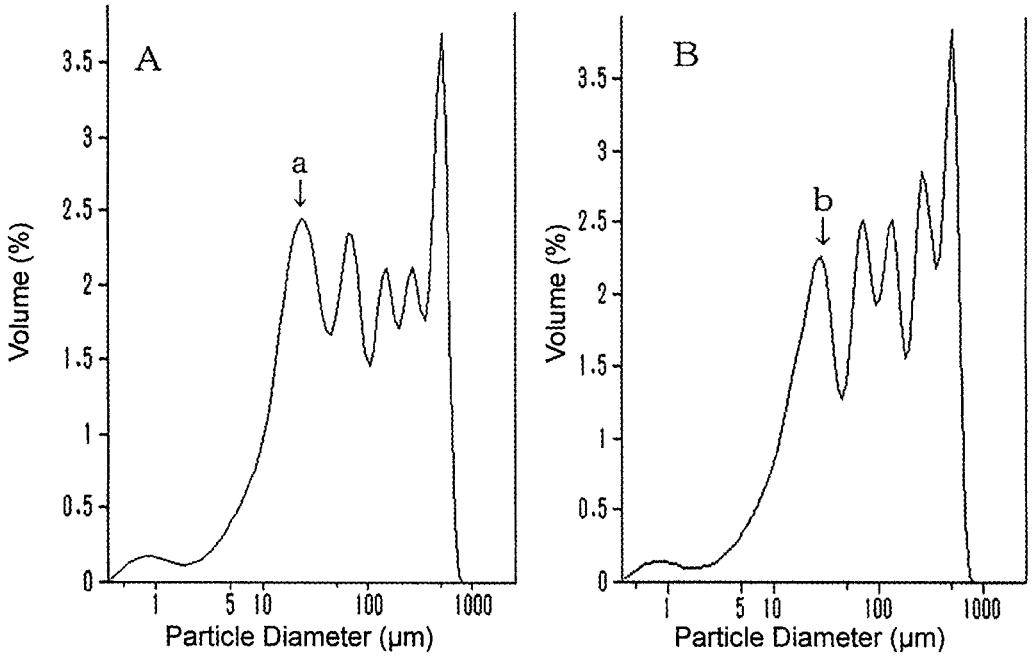

FIG. 12: A and B are graphs showing the particle size distributions of the whole-grain flours obtained by grinding surface-treated wheat and untreated raw wheat in Example 2, respectively.

MODE FOR EMBODYING THE INVENTION

Below, the present invention is described in more detail by way of mode of embodiment with reference to the appended Drawings.

FIGS. 1-9 depict an apparatus for producing a surface-worked granular product of one mode of embodiment.

In FIGS. 1-9, the apparatus 1 for producing a surface-worked granular product of the embodiment is provided with a cylindrical retainer 3 forming a passage 3*e* of granular material 2 along the inner peripheral surface of the cylindrical retainer 3, a rotary working device 4 which is installed to a rotary shaft 6 extending along the central axis of the cylindrical retainer 3, a raw material supply site 17 for supplying raw granular material 2*a* to the cylindrical retainer 3, a product takeout site 15 for taking out a surface-worked granular product 2*b* from the cylindrical retainer 3, an occurring dust discharge site 8 for discharging fine foreign substances and occurring dust from upper portion of the cylindrical retainer 3, and a crushed material discharge site 9 for discharging crushed material from lower portion of the cylindrical retainer 3. The cylindrical retainer 3 has a multiplicity of apertures 3*b* and a multiplicity of retaining sites 3*a* for temporarily retaining each granule of granular material 2 circling and traveling along the inner surface of the retainer 3. The rotary working device 4 has a multiplicity of working protrusions 4*aa*, 4*ba*, 4*ca* protruding from the outer peripheral surface of the working device 4 for removing foreign substances and surface-working the granular material 2 so as to form a rough surface by contacting with the granular material 2. The occurring dust discharge site 8 is constituted so as to discharge, by suction, fine foreign substances and occurring dust 8*c* from upper portion of the cylindrical retainer 3 through the apertures 3*b* and to float the granular material 2.

The retaining sites 3*a* provided in the cylindrical retainer 3 are composed for temporarily retaining each granule of granular material 2 circling and traveling along the inner surface of the cylindrical retainer 3 to generate resistance to the circling and traveling granular material 2 so that surface-working of the granular material 2 is accelerated. The apertures 3*b* are provided for ventilation mainly, while a part of the apertures 3*b* (for instance, opening edge of the apertures 3*b*) may be provided for the retaining sites 3*a* concurrently. In this case, an aperture 3*b* has smaller diameter than the size of the each granule of the granular material 2 so as to retain the granule 2 wherein opening edge of the aperture 3*b* acts as a retaining site 3*a*. Apart of the opening edge of the aperture 3*b* may protrude inward at a location downstream side of the circling and traveling granular material 2 to increase retaining ability so that hitting power and impact are caught with the protruding portion to increase surface-working ability. Shape and size of the aperture 3*b* can be selected optionally according to shape and size of the granule 2 so that the granule 2 does not pass through. For example, in case of brown rice, an elliptical or oval aperture is usually adopted while a circular aperture may be adopted. A protrusion protruding from inner surface of the cylindrical retainer 3 apart from apertures 3*b* may be provided as retaining sites 3*a*. Shape, size or the like of the retaining site 3*a* and the aperture 3*b* may be varied to meet with function, operation or others at the portion of the cylindrical retainer 3. For instance, a retaining site 3*a* and an aperture 3*b* are composed, at most portions, to have high retaining ability in order to increase resistance to the circling and traveling granular material 2, while large apertures 3*b* are provided at an occurring dust discharge site 8 in order to facilitate passing through of air and occurring dust, or increased number of apertures 3*b* are provided at a crushed material discharge site 9 in order to facilitate passing through of a crushed material. Surface-working of the granular material 2 by a rotary working device 4 is performed by generation of resistance to circling and traveling granular material 2 when the granular material 2 is temporarily retained with or removed from the retaining sites 3*a*.

The cylindrical retainer 3 is formed in a cylindrical configuration from plural perforated plates 3*c*, 3*d* and provided with plural diameter adjustment means 7, 7*a* constituted from binding bands which have respectively a binding jig 7*d* being operated from outside to adjust the diameter of the cylindrical retainer 3. By adjusting the diameter of the cylindrical retainer 3, size of passage 3*e* formed between the inner circumferential surface of the cylindrical retainer 3 and the rotary working device 4 is adjusted so that surface-working rate of granular material 2 is adjusted. The cylindrical retainer 3 is composed from plural perforated plates 3*c*, 3*d* overlapping slidably so that the diameter of the cylindrical retainer 3 is easily adjusted by adding compressive load from outside. The plural perforated plates 3*c*, 3*d* composing the cylindrical retainer 3 may have the same or different retaining sites 3*a* and/or apertures 3*b*. The cylindrical retainer 3 is set in basically horizontal direction with slight inclination so that gravity is utilized for traveling of granular material 2.

The rotary working device 4 provided in the cylindrical retainer 3 is installed to a rotary shaft 6 extending along the central axis of the cylindrical retainer 3 so as to rotate. The rotary working device 4 is provided with a multiplicity of working protrusions 4*aa*, 4*ba*, 4*ca* protruding from the outer surface of the working device 4 so as to contact with the granular material 2 to remove foreign substances and to perform surface-working of the granular material 2 by rotation of the rotary working device 4. The rotary working device 4 is provided with plural working units 4*u* installed to the rotary shaft 6 in layers, and the working unit 4*u* in the Figures is provided with plural surface-roughening tools 4*a*, 4*b*, 4*c* and one releasing/dispersing tool 4*d* in layers.

The surface-roughening tools 4*a*, 4*b*, 4*c* are composed of circular disks 4*ab*, 4*bb*, 4*cb* installed to the rotary shaft 6 and working protrusions 4*aa*, 4*ba*, 4*ca* protruding radially from the periphery of the disks 4*ab*, 4*bb*, 4*cb*, wherein the working protrusions 4*aa*, 4*ba*, 4*ca* contact, by rotation of the surface-roughening tool 4*a*, 4*b*, 4*c*, with the granular material 2 fluidized in a passage 3*e* between the cylindrical retainer 3 and the rotary working device 4 to perform surface-roughening of the granular material 2.

The working protrusions 4*aa*, 4*ba*, 4*ca* may have an arbitrary shape decided according to conditions of the surface-working, such as flat plate shape, curved piece shape, saw tooth shape, nail shape, or the like having a width corresponding to the thickness of the disks 4*ab*, 4*bb*, 4*cb* and protruding in the radial direction or towards the front or rear of the rotation. In the embodiment, surface-roughening tool is provided with working protrusions 4*aa*, 4*ba*, 4*ca* protruding toward the rear of the rotation in a curved shape so that the front surface of the rotation of the surface-roughening tool 4*a*, 4*b*, 4*c* forms convex, whereby the impact on the granular material 2 can be reduced, dispersed and uniformized. When the rotary working device 4 having such working protrusions 4*aa*, 4*ba*, 4*ca* is rotated to contact with the granular material 2 as floated and fluidized in a cylindrical retainer 3, resistance to rotation of the rotary working device 4 is low so that crushing of a granule 2 and peeling of the surface is prevented to forma large number of irregular and minute flaws and/or scrapes on the surface of the granular material 2 whereby a rough surface is formed. Sharp edges are formed at both sides of the edge portions of the working protrusions 4*aa*, 4*ba*, 4*ca* to contact with the granular material 2, so that minute flaws and/or scrapes are formed in the surface layer portion of the granular material 2. As surface-working is also performed at the retaining site 3*a* of the cylindrical retainer 3 by rotation of the rotary working device 4, the retaining site 3*a* is preferably formed, as similarly to working protrusions 4*aa*, 4*ba*, 4*ca*, so as to disperse the impact and to facilitate performing fine surface-working. Plural surface-roughening tools 4*a*, 4*b*, 4*c* are stacked to form working unit 4*u* in which the middle surface-roughening tool 4*b* has lower height of periphery than surface-roughening tools 4*a* and 4*c* so that differences in level along the periphery of the rotary working device 4 are formed to facilitate surface-working of irregular-shaped portions such as groove of wheat.

Releasing/dispersing tool 4*d* is provided on the downstream side of the working unit 4*u* and has releasing vane 4*da* extending radially from base portion 4*dc* installed to the rotary shaft 6 to release and disperse, toward the inner surface of the cylindrical retainer 3, the granular material 2 residing in temporarily storing portion 4*db* which is formed adjacent to the releasing vane 4*da* around the base portion 4*dc*. The temporarily storing portion 4*db* is formed in a shape and size such that at least one granule of granular material 2 flows in from passage 3*e* between cylindrical retainer 3 and surface-roughening tool 4*c* on the upstream side and is temporarily stored therein. The releasing vane 4*da* is formed in an agitation blade shape which pushes out the granular material 2 in the temporarily storing portion 4*db* toward the inner peripheral surface of the cylindrical retainer 3 by rotation of the releasing/dispersing tool 4*da*. The releasing vane 4*da* is larger in protruding length and width than a working protrusion 4*aa*, 4*ba*, 4*ca* of the surface-roughening tool 4*a*, 4*b*, 4*c* and have curved piece shape protruding toward the rear of the rotation in a curved shape so that the front surface of the rotation is convex, whereby impact on the granular material 2 can be reduced and uniformized.

Working unit 4*u* in the Drawing is composed of one or more surface-roughening tools 4*a*, 4*b*, 4*c* and one releasing/dispersing tool stacked, while plural working units 4*u* are stacked repeatedly to form a rotary working device 4, by which surface-roughening by surface-roughening tools 4*a*, 4*b*, 4*c* and releasing and/or dispersing by a releasing/dispersing tool 4*da* are repeated.

The rotary working device 4 is provided, in or outside of the working unit 4*u*, with a stacked weir member 5 for controlling flow of the granular material 2 along the inner surface of the cylindrical retainer 3. The weir member 5 is composed of a circular disk of larger diameter than surface-roughening tools 4*a*, 4*c*, having a petal shape in which convex 5*a* and concave 5*b* are uniformly dispersed in the outer peripheral portion to control the flow of the granular material 2. Since the weir member 5 is provided for controlling and equalizing the flow rate of the granular material 2, the weir member 5 is not required to be stacked in each working unit 4*u*, while in FIG. 1, plural weir members 5 are stacked in a dispersed manner in the longitudinal direction inside the cylindrical retainer 3 and further stacked in the most downstream portion.

Each member composing the rotary working device 4 is installed to the rotary shaft 6 loosely so as to allow fluctuating or sliding in rotational direction R1, axial direction R2, lateral direction R3 and/or other directions so that 1) impact on the granular material 2 by each member of the rotary working device 4 is reduced, 2) crushing of a granule 2 and peeling of the surface are prevented and 3) a large number of irregular and minute flaws and/or scrapes are formed on the surface of the granular material 2 to form a rough surface. In order to allow fluctuating or sliding in rotational direction R1, lateral direction R3 and/or other directions, each member composing the rotary working device 4 is installed to the rotary shaft 6 loosely so as to form slight gaps 12 between the member and the rotary shaft 6 and between the member and engaging tool 11 (for example, key 11*a* and groove 11*b*) to absorb impact. In order to allow fluctuating or sliding in axial direction R2, the end portion of the rotary working device 4 is fixed by an end-fixing tool 23 composed of double nuts and a spring washer or the like to form slight gaps in the axial direction.

The raw material supply site 17 is provided with a conveyor cylinder 17*a* connected to the entrance side of the cylindrical retainer 3 and a screw conveyor 18 installed inside of the conveyor cylinder 17*a* so as to feed raw granular material 2*a* from the supply channel 17*d* to the starting end portion of the passage 3*e* of the cylindrical retainer 3. For supplying raw granular material 2 in an amount suitable for the surface-working to the passage 3*e*, a screw conveyor 18 having a screw installed on the outer circumferential surface of a rotary body having a shape and size corresponding to the rotary working device 4 is provided in the conveyor cylinder 17*a* which has a shape and size nearly corresponding to the cylindrical retainer 3 and is connected to the cylindrical retainer 3. A stabilizing plate 17*b* for stabilizing the supply thickness of raw granular material 2*a* is provided in the supply channel 17*d* connected to the conveyor cylinder 17*a* on the upper side of the screw conveyer 18. The stabilizing plate 17*b* is provided with an opening 17*c* to restrict supply amount of the raw granular material 2*a*. The raw granular material 2*a* is supplied to raw material supply site 17 by a flow rate adjusting device such as a rotary valve or the like (not shown) so that supply amount of the raw granular material 2*a* is stabilized.

Starting end side of the conveyor cylinder 17*a* of the screw conveyor 18 is held by a holding member 19 attached to a support member 20. Starting end side of the cylindrical retainer 3 is fixed to the outer peripheral portion on the terminal end side of the conveyor cylinder 17*a* by a fixing tool 16. In the case where the diameter of the terminal end side of the cylindrical retainer 3 is adjusted to be smaller than the starting end side, the terminal end side of the cylindrical retainer 3 is held by a holding member 19*a* attached to the support member 20*a* interposing holding members 7*b* and 7*c*. The screw conveyor 18 is attached to the rotary shaft 6 for installing the rotary working device 4, and the starting end side of the rotary shaft 6 is connected to a driving device 21 attached to the supporting body 20 via a coupling 22. The end side of the rotary shaft 6 is rotatably attached to a bearing 24 attached to the support member 20*a*.

An occurring dust discharge site 8 is provided, in the upper part of the cylindrical retainer 3, with an occurring dust collector 8*a* covering a number of the apertures 3*b*. An occurring dust discharge path 8*b* connected to the occurring dust collector 8*a* is connected to a suction device (not shown) such as an external bag filter or the like. By sucking from the occurring dust collector 8*a* through the covered apertures 3*b*, the granular material 2 in the cylindrical retainer 3 is floated to discharge out occurring dust 8*c* including peeled fine foreign substances. The occurring dust discharge site 8 is formed so as to prevent, by air cooling, heat generation and heat accumulation in the cylindrical retainer 3 so that degeneration, alteration, etc. of the granular material 2 are prevented.

A crushed material discharge site 9 is provided, in the lower part of the cylindrical retainer 3, with a crushed material receiver 9*a* covering a number of the apertures 3*b*. Crushed material discharge path 9*b* communicates from the lower part of the crushed material receiver 9*a* to outside so that crushed material 9*c* generated by surface-working is collected to the crushed material receiver 9*a* through the covered apertures 3*b* and discharged out of the cylindrical retainer 3.

The product takeout site 15 is formed so as to take out surface-worked granular product 2 from worked product takeout path 13 connected to the end portion of the cylindrical retainer 3, to sort the taken out surface-worked granular product 2 at the sorting site 14, and to take out from the product takeout site 15 as product granular material 2*b*. The sorting site 14 is provided with a sorter selectively removing foreign substances, broken material or the like. In the case that a magnetic material is used as a constituent material of the apparatus 1, a magnetic separator is used as the sorter to remove the fragments as foreign substances. In addition, sorting with electromagnetic waves such as visible light, sorting with a sieve, sorting with wind selection or the like can be adopted.

The process of producing a surface-worked granular product using the apparatus 1 described above is carried out by supplying raw granular material 2*a* to the cylindrical retainer 3 to perform surface-working of granular product 2. Specifically, in a state of sucking in the direction of the arrow R8 from the upper part of the cylindrical retainer 3 through the aperture 3*b*, by driving suction device (not shown) such as a blower of a bag filter connected to the occurring dust discharge site 8, driving device 21 is driven to rotate screw conveyor 18 so as to supply raw granular material 2*a* from the supply channel 17 to the starting end of the cylindrical retainer 3. At the same time, rotary working device 4 is rotated in the direction of the arrow R1 to perform surface-working of granular product 2 in a state in which the granular material 2 is floated by the air flowing in from the aperture 3*b* in the direction of the arrow R7. Thereby, the granular material 2 supplied from the raw material supply site 17 enters the passage 3*e* formed between the inner circumferential surface of the cylindrical retainer 3 and the rotary, working device 4 to receive surface-working during circling in direction of arrow R6 and traveling along the inner surface of the retainer 3.

Here, a part of the granular material 2 is temporarily retained at the retaining site 3*a* formed in the cylindrical retainer 3 and dispersed by repulsive force. By rotation, in this state, of the rotary working device 4 in the direction of the arrow R1, working protrusions 4*aa*, 4*ba*, 4*ca* radially protruding from the peripheral portion of the surface-roughening tool 4*a*, 4*b*, 4*c* of the working unit 4*u* contact with the granular material 2 fluidized in the passage 3*e* to remove foreign substances and to perform surface-working of granular product 2 so as to form a rough surface. The granular material 2 in the passage 3*e* moves to go back and forth between the cylindrical retainer 3 and the rotary working device 4 during rotation of the rotary working device 4 as indicated by arrows R4 and R5 in FIG. 3, while total movement is considered to be in a spiral shape along the inner circumference circle of the cylindrical retainer 3 as indicated by R6. Arrow R7 in FIG. 5 indicates the suction direction of air from the aperture 3*b*, but not shown in FIG. 3 and others.

In the above operation, surface-working of granular material 2 is performed by rotating a rotary working device 4 in a state where the granular material 2 is floated so that the granular material 2 is further fluidized and a large number of irregular and minute flaws and/or scrapes are formed on the surface of the granular material 2. That is, since in the above operation wherein the granular material 2 is fluidized by rotating the rotary working device 4 in a state where the granular material 2 is floated, the granular material 2 contacts with the rotary working device 4 in a state where values of friction, impact, contact resistance and heat generation between granules 2 or between granules 2 and rotary working device 4 are low levels, a large number of irregular and minute flaws and/or scrapes are formed on the skin layer so that a rough surface is formed and surface characteristics different from raw granular material such as breakability, permeability, wettability and the like of the outer layers are imparted.

Since working protrusions 4*aa*, 4*ba*, 4*ca* protruding radially from the periphery of the surface-roughening tools 4*a*, 4*b*, 4*c* of the working units 4*u* protrude toward the rear of the rotation in a curved shape so that the front surface of the rotation is convex, the impact on the granular material 2 can be reduced, dispersed and uniformized. When the rotary working device 4 having such working protrusions 4*aa*, 4*ba*, 4*ca* is rotated to contact with the granular material 2 as floated and fluidized in a cylindrical retainer 3, resistance to rotation of the rotary working device 4 is low so that crushing of a granule 2 and peeling of the surface are prevented while a large number of irregular and minute flaws and/or scrapes are formed on the surface of the granular material 2.

In the case of granular material 2 having an irregular-shaped portion such as wheat or barley, since plural surface-roughening tools 4*a*, 4*b*, 4*c* are stacked to form working unit 4*u* in which surface-roughening tool 4*b* has lower height of periphery than surface-roughening tools 4*a* and 4*c*, differences in level along the periphery of the rotary working device 4 are formed so that the edge portions of the surface-roughening tools 4*a*, 4*c* having high height on both sides contact with irregular-shaped portions such as groove of wheat or the like to facilitate removing foreign substances and surface-working of the irregular-shaped portion. In the case of granular material 2 having no irregular-shaped portion (e.g. groove) such as brawn rice, surface-roughening tool 4*b* having lower height of periphery may be omitted or replaced with a spacer having no working protrusions 4*ba*.

Granular material 2, traveling in passage 3*e* between cylindrical retainer 3 and rotary working device 4, enters into temporarily storing portion 4*db* of the releasing/dispersing tool 4*d* as depicted in FIG. 5 and then is released in the direction of the arrow R10 by a releasing vane 4*da* extending radially from the base portion 4*dc* toward the inner surface of the cylindrical retainer 3 to be dispersed. The granular material 2, traveling in the passage 3*e* between the cylindrical retainer 3 and the rotary working device 4, tends to form a laminar flow along the arrow R6 in the region where the granular material 2 contacts with the surface-roughening tool 4*a*, 4*b*, 4*c*, while the granular material 2 in the temporarily storing portion 4*db* is released by a releasing vane 4*da* in the direction of the arrow R10 to be dispersed forming a mixed flow in the region where the granular material 2 contacts with the releasing/dispersing tool 4*d*. These operations are repeated by each working unit 4*u*, whereby the granular material 2 is uniformized and the fluidized state is maintained.

The flow of the granular material 2 along the inner circumferential surface of the cylindrical retainer 3 is controlled by weir member 5 provided inside or outside the working unit 4*u* so that the residence time of the granular material 2 becomes longer and the flow rate of the granular material 2 passing through passage 3*e* is adjusted whereby uniform surface-working is performed. In the case where the weir member 5 has a combination of convex 5*a* and concave 5*b* along the periphery of the weir member 5, the flow of the granular material 2 is controlled by the convex 5*a* while the granular material 2 moves over the concave 5*b*. In the case where the weir member 5 is circular, the flow of the granular material 2 is controlled around the circumference while controlled at the major axis portion in the case of ellipse.

Since each member composing the rotary working device 4 is installed to the rotary shaft 6 loosely so as to allow fluctuating or sliding in rotational direction R1, axial direction R2, lateral direction R3 and/or other directions, impact given to the granular material 2 by each member of the rotary working device 4 is further reduced, crushing of a granule 2 and peeling of the surface are prevented, and a large number of irregular and minute flaws and/or scrapes are formed on the surface of the granular material 2 to form a rough surface.

When the diameter of the cylindrical retainer 3 is adjusted by operating binding jig 7*d* of the diameter adjustment means 7, 7*a*, size of passage 3*e* formed inside the cylindrical retainer 3 is adjusted so that surface-working rate of granular material 2 can be adjusted. Since the cylindrical retainer 3 is composed from plural perforated plates 3*c*, 3*d*, adjustment of size of the cylindrical retainer 3 becomes easier by overlapping perforated plate 3*c*, 3*d* slidably.

At the occurring dust discharge site 8, by sucking from the upper portion of the cylindrical retainer 3 through the apertures 3*b*, the granular material 2 is floated, and peeled fine foreign substances and occurring dust 8*c* are collected by the occurring dust collector 8*a*, discharged outside and captured by an external bag filter or the like. Thereby, redeposit of the occurring dust 8 to the granular material 2, heat generation, heat storage and the like are prevented. At this time, air flows to enter cylindrical retainer 3 through the aperture 3*b* as shown by an arrow R7 in FIG. 5, flows at the surface-roughening tool 4*a*, 4*b*, 4*c* as indicated by an arrow R6 in FIG. 3, and then flows at the releasing/dispersing tool 4*d* as indicated by arrows R6, R10 and R8 in FIG. 5.

In the crushed material discharge site 9, crushed material 9*c* is taken out from lower portion of the cylindrical retainer 3 through the apertures 3*b* to a crushed material receiver 9*a*, together with heavy foreign substances, broken structure of the granular material 2 and the like, and then discharged out of the cylindrical retainer 3 via crushed material discharge path 9*b* as indicated by arrows R9 in FIG. 9.

In the product takeout site 15, worked product 2*b* taken out from the end portion of the cylindrical retainer 3 via worked product takeout path 13 is sorted out at the sorting site 14 to remove foreign substances and defective products, and then taken out as product granules 2*b*. In the case that a magnetic material such as steel is used as a constituent material of the apparatus 1, specifically cylindrical retainer 3 and/or rotary working device 4, fragments of the magnetic material mixed in the granular material 2 are removed by magnetic selection in the sorting site 14. Other foreign substances such as pebbles and plastics are removed by visible light or other electromagnetic waves, gravity or the like.

The granular product 2*b* produced in the above process is granular material which has surface characteristics different from that of the raw granular material 2*a* and contains substantially the same useful ingredients as contained in the raw granular material 2*a* without degeneration, denaturation or substantial removal, while foreign substances such as soil, bacteria or the like attached to the raw granular material 2*a* are removed. Such surface-worked granular material 2*b* has a rough surface constituted from a large number of irregular and minute flaws and/or scrapes which impart surface characteristics of the outer layers different from the raw granular material 2*a* such as breakability, permeability, wettability and the like, so that such characteristics as milling aptitude, cooking performance, sanitation, nutrition, texture and the like are improved.

In the case of surface-worked granular material 2*b* obtained from raw granular food material 2*a* originating from a plant seed such as a granular cereal, since a rough surface caused by a large number of irregular and minute flaws and/or scrapes are formed on the tough and/or low water-permeable skin layer, different surface characteristics such as breakability, permeability, wettability and the like are imparted to improve such characteristics as milling aptitude, cooking performance, sanitation, nutrition, texture and the like. In the case of surface-worked brown rice, useful ingredients such as skin layer, aleurone layer, embryo and the like are not removed and the appearance is similar to raw brown rice, while the water absorbency is so high that cooking can be possible by a short time of immersion. In rice cooking, a large number of minute flaws and/or scrapes on the skin layer expand due to increase in the turgor pressure of the endosperm portion to generate a large number of cracks in wide area, decreasing coarse skin layer fractions so that an uncomfortable feeling by a coarse coating layer fraction in mouth is reduced to give good oral texture like cooked polished rice. In the case of cooking whole grain buckwheat as buckwheat rice, water absorbency, texture and the like are improved by forming rough surface, too.

In the case of milling prior to cooking of wheat, buckwheat or the like, crushing starts from the minute flaws and/or scrapes in the skin layer so that the tough skin layer becomes a fine crushed material which disperses in the powdered material of other parts to form homogeneous flour whereby processing characteristics such as bread making property and noodle forming property are improved.

The processed goods of the surface-worked granular material according to the present invention are obtained by secondary processing such as milling, cooking and the like of the surface-worked granular material produced in the process explained above. The processed goods have specific characteristics which appeared as new characteristics by the secondary processing of the surface-treated granular material. In the case that the secondary processing is milling of the surface-worked granular material, a powder product having improved dispersibility is obtained in which the tough skin layer portion is finely pulverized to disperse in the powdered material of other parts including albumen. In the case that the secondary processing is cooking of the surface-worked granular material, cooked foods excellent in appearance, flavor and texture can be produced due to the improved characteristics of the surface-treated granular material such as water absorbability, cooking performance, dispersibility and the like. Further, in the case of surface-worked granular material subjected to no high-temperature treatment, biologically active substances such as γ-aminobutyric acid are enriched by enzymes by soaking or the like in secondary processing so that new added value can be given to the cooked goods.

EXAMPLES

In the following, the present invention will be explained by way of Examples which should not be construed as limiting the invention. In the Examples, the samples of raw brown rice and raw wheat were commercially available brown rice and raw wheat through precise sorting after drying by mechanical dryer and storage.

Example 1

In the surface-working of granular material according to the present invention, a large number of irregular and minute flaws and/or scrapes are formed on the surface of raw granular material 2*a* to form a rough surface. Accordingly, surface-worked brown rice (polishing yield 99.8%) was produced by surface-working of unprocessed brown rice, Koshihikari produced in Toyama Japan using the apparatus of FIGS. 1 to 9. Appearance traits of the surface-worked brown rice and unprocessed raw brown rice were compared and examined using a stereoscopic microscope. The results are shown in FIG. 10.

In the microscopic image of the surface-worked brown rice of low magnification in FIG. 10A, the embryo (arrow) on the right side of the top of the surface-processed brown rice (A) remained, while no defect in the tissues of the ventral side (right side) and the dorsal side (left side) was observed. The microscopic image of the surface-worked brown rice in low magnification in FIG. 10A had almost the same appearance trait as the unprocessed raw material brown rice (B) in FIG. 10B, so that it was difficult to discriminate between the surface-worked brown rice and the unprocessed raw brown rice by naked eye observation.

In the microscopic image of high magnification in FIG. 10 AL, minute flaws and/or scrapes indicated by arrows were observed in the surface layer portion of the surface-worked brown rice (AL), while no flaw and/or scrape was observed in the raw brown rice surface layer portion (BL) in FIG. 10 BL. For measurement, scales of 0.5 mm are depicted in FIG. 10 AL and FIG. 10 BL respectively. Because of these minute flaws and/or scrapes, surface-worked brown rice becomes easier to chew than the unprocessed raw brown rice, so it was considered that the texture of surface-worked brown rice was improved. Further, it was thought that the minute flaws and/or scrapes on the skin layer improved water absorbency of the surface-worked brown rice to shorten immersion time for cooking.

In order to evaluate the appearance traits of various rice grains by spectral reflectance, surface-worked brown rice produced with apparatus of FIGS. 1-9 (polishing yield: 99.8%), unprocessed raw brown rice, skin abrased rice and polished rice polished with ordinary apparatus for polished rice (polishing yield: 90.8%) was analyzed with whiteness meter. Whiteness was measured by reflectance measurement (45 degrees) with blue light (440 nm), and by equally divided measurement with white and black standard board (JIS Z 8722 compliant, Kett Science Laboratory whiteness meter C-300). The results are shown in Table 1.

In the analysis results of Table 1, the whiteness of surface-worked brown rice (21.5%) and unprocessed raw brown rice (21.4%) were almost equal, so that it was difficult to identify by visual inspection. However, the whiteness (23.9%) of the skin abrased rice (occurred due to maladjustment at the time of drying during harvesting, and the like, and causing quality deterioration) was higher than that of the surface-worked brown rice, so that it was possible to discriminate visually. Whiteness of the polished rice used for analysis was 41.5%, while whiteness standard of polished rice according to Japanese Industrial Standard was 40% (polishing yield: about 90%).

TABLE 1

Whiteness of surface-worked brown rice, unprocessed raw brown rice, skin abrased rice and polished rice

| | Whiteness (%) | Polishing yield (%) |
|---|---|---|
| Surface-worked brown rice | 21.5 | 99.8 |
| Unprocessed raw brown rice | 21.4 | Unprocessed |
| Skin abrased rice | 23.9 | Unprocessed |
| Polished rice | 41.5 | 90.8 |

Table 2 shows the result of analysis for nutritional ingredients, dietary fiber and number of viable bacteria on surface-worked brown rice (polishing yield: 99.8%) and unprocessed raw brown rice. The analysis was carried out by requesting Japan Food Research Laboratories, Inc. Since the moisture contents of the surface-worked brown rice and the unprocessed raw brown rice tested were 14.7% and 14.6%, respectively, the nutritional ingredients were converted to dry matter (mg/100 g), and the dietary fiber converted to dry matter (g/100 g) for comparison. Vitamin E was expressed as α-tocopherol and γ-tocopherol.

In the analytical result of nutritional components of surface-worked brown rice and unprocessed raw brown rice in Table 2, values of vitamin $B_1$, vitamin $B_6$ and pantothenic acid were the same, while α-tocopherol and niacin tended to be slightly higher in surface-worked brown rice. Since these ingredients are mainly localized in the embryo and the aleurone layer, the fact that the analyzed values are almost in agreement, conceivably means that these tissues are not removed from the raw brown rice to retain in the surface-worked brown rice. γ-Oryzanol content (42.2 mg/100 g) in the surface-worked brown rice retaining embryo and aleurone layer showed a high value. Ratio of insoluble dietary fiber (3.0 g) and water-soluble dietary fiber (1.1 g) to surface-worked brown rice was 3:1, and the sum of both was almost the same as the unprocessed raw brown rice. Insoluble dietary fiber amount was decreased by 12% compared to the unprocessed raw brown rice (3.4 g). This was considered to be due to the fact that the skin layer portion having a high insoluble dietary fiber content was microscopically scratched and a part thereof was removed. Regarding bacterial test, the number of viable bacteria in the surface-worked brown rice was $8.2\times10^5$/g, which was lower than that of unprocessed raw brown rice ($1.9\times10^6$/g), so it was thought that a part of the microorganisms attached to the skin layer was sucked and removed together with occurring dust during surface-working.

TABLE 2

Various nutritional components, dietary fiber and number of viable bacterial in surface-worked brown rice and unprocessed raw brown rice

| | Surface-worked brown rice | Unprocessed raw brown rice |
|---|---|---|
| Vitamin $B_1$ (mg/100 g) | 0.5 | 0.5 |
| Vitamin $B_6$ (mg/100 g) | 0.5 | 0.5 |
| α-Tocopherol (mg/100 g) | 1.9 | 1.8 |
| γ-Tocopherol (mg/100 g) | 0.2 | 0.2 |
| Pantothenic acid (mg/100 g) | 1.2 | 1.2 |
| Niacin (mg/100 g) | 5.8 | 5.5 |
| γ-Oryzanol (mg/100 g) | 42.2 | 35.8 |
| Insoluble dietary fiber (g/100 g) | 3.0 | 3.4 |
| Water-soluble dietary fiber (g/100 g) | 1.1 | 0.6 |
| Number of bacteria (/g) | $8.2 \times 10^5$ | $1.9 \times 10^6$ |
| Number of heat-resistant spore-forming bacteria (/g) | <300 | <300 |

In order to carry out immersing water absorption test of surface-worked brown rice (polishing yield: 99.8%), unprocessed raw brown rice and polished rice (polishing yield: 90.5%), each sample was, for pretreatment, left as it was at 20° C. and 70% relative humidity for one week to adjust the moisture content. Moisture contents of the unprocessed raw brown rice, the surface-worked brown rice, and the polished rice tested were 14.9%, 14.9% and 15.0% (according to AACC Method 44-19), respectively. Next, each sample was immersed in reverse osmosis-treated water at 20° C., to examine variation by time of the water absorption rate, wherein the sample immersed was dehydrated at 1,054×g for 5 minutes and weighed to measure water absorption (3rd edition annexed to the National Tax Agency, 3rd Revision, Brewing society of Japan, Inc., 1987). The results are shown in FIG. 11.

According to the result of the immersing water absorption test in FIG. 11, the water absorption rate at 60 minutes after the start of immersion was 9.8% for the surface-worked brown rice, 6.7% for the unprocessed raw brown rice, and 19.9% for the polished rice, so that the rate of the surface-worked brown rice was 1.46 times the unprocessed raw brown rice. The water absorption rate of the polished rice reached almost the upper limit in 60 minutes. The surface-worked brown rice reached 19.3% in 240 minutes, while the unprocessed brown rice was 17.6% even after 360 minutes. It is generally said that immersion time of polished rice (water addition amount about 150%) at room temperature is preferably 30 minutes to 60 minutes, while immersion time of unprocessed raw brown rice (water addition amount about 180%) is preferably 360 minutes or more. The surface-worked brown rice (water addition amount about 180%) had a water absorption rate of about 10% after 60 minutes of immersion. A result of rice cooking test of the surface-worked brown rice after 60 minutes of immersion having water absorption rate of about 10% showed that cooking of the surface-worked brown rice was possible. This was thought to be caused by high water absorbability of the surface-worked brown rice due to minute flaws and/or scratches (FIG. 1) formed in the skin layer.

Brown rice produces γ-aminobutyric acid by glutamate decarboxylase in embryo at the time of germination. Since the surface-working of Example 1 is not subjected to a high-temperature treatment that impairs the enzymatic activity, there is a possibility that γ-aminobutyric acid content is enriched in the immersing step during cooking. Accordingly, the surface-worked brown rice, Koshihikari (polishing yield: 99.8%), unprocessed raw brown rice and polished rice (polishing yield: 90.8%) were immersed in water at room temperature (23° C.) to enrich γ-aminobutyric acid. Immersion test and analysis with an amino acid automatic analyzer were conducted by requesting Japan Food Research Laboratories, Inc. The analysis results of the γ-aminobutyric acid content are shown in Table 3.

In Table 3, the contents of γ-aminobutyric acid were converted in terms of dry matter (mg/100 g) to be compared, because the moisture contents after immersion of the test sample were different. γ-Aminobutyric acid contents of the surface-worked brown rice having embryo and others and the unprocessed raw brown rice showed high values of 3 to 5 times the content of the polished rice from which embryo and others had been removed in polishing step. As surface-worked brown rice had high water absorbency and cooking was possible with immersion time of 60 minutes, analysis of γ-aminobutyric acid contents after immersion for 60 minutes was carried out, resulting that γ-aminobutyric acid contents of the surface-worked brown rice and the unprocessed raw brown rice increased to about 16 mg/100 g. Further, since brown rice was often cooked by immersion for 360 minutes or more in ordinary households, analysis of γ-aminobutyric acid contents after 360 minutes of immersion was also carried out, resulting that γ-aminobutyric acid contents of the surface-worked brown rice and the unprocessed raw brown rice decreased slightly compared to 60 minutes immersion. From this, it was considered that the γ-aminobutyric acid contents reached almost the upper limit by 60 minutes immersion. γ-Aminobutyric acid contents in the polished rice after immersion for 360 minutes was 1.6 mg/100 g showing a low value almost the same as before immersion. Therefore, it was considered that if water absorption of product granular material was increased without impairing enzyme activity as in the present invention, increased amounts of useful ingredients such as γ-aminobutyric acid was able to be obtained in rice cooking by shorter immersion time of 60 minutes as in the case of polished rice.

TABLE 3

γ-Aminobutyric acid contents in surface-worked brown rice, unprocessed raw brown rice and polished rice

| Immersion time (min.) | 0 | 60 | 360 |
|---|---|---|---|
| Surface-worked brown rice (mg/100 g) | 6.7 | 16.0 | 13.2 |
| Unprocessed raw brown rice (mg/100 g) | 4.0 | 16.8 | 14.0 |
| Polished rice (mg/100 g) | 1.3 | — | 1.6 |

In the present Example, the surface-working was carried out under dry conditions, wherein occurring dust was sucked and removed outside of the cylindrical retainer 3 to prevent remaining and attaching to the product granular material. Accordingly, the surface-worked brown rice (polishing yield: 99.8%), unprocessed raw brown rice, rinse-free rice (Musenmai) and polished rice (polishing yield: 90.8%), respectively, were rinsed and the turbidities of the rinsing effluents were measured to examine occurring dust remained. Rinse test was carried out according to the Musenmai Association of Japan Method and the Rice Fair Trade Promotion Council Method (former Food Agency Method). Turbidity measurement was conducted by a digital turbidity meter (Nodatushin Co., Ltd., M 204) according to the Japan Industry Standard (JIS K 0101, Industrial Water Test). The turbidity meter has a display indicating turbidity with "ppm", which corresponds to "mg/L" or "degree" in JIS K 0101. The results are shown in Table 4.

According to the results of the turbidity measurement shown in Table 4, turbidity of the surface-worked brown rice was 4.4 ppm which was a low value of only 21% of the turbidity (21 ppm) of the rinse-free rice which was recommended with rinse before cooking to be unnecessary. Turbidity of the polished rice, which was usually rinsed several times before cooking, was 92 ppm which was about 21 times that of the surface-worked brown rice (4.4 ppm). For reference, standard turbidity value of rinse-free rice by the Musenmai Association of Japan is 28 ppm.

In a factory for producing cooked rice, there are restrictions on biochemical oxygen demand (BOD) and chemical oxygen demand (COD) in wastewater to be discharged from the viewpoint of preventing water pollution. It was understood that the surface-worked brown rice was able to be used as rinse-free rice for business use at a factory or the like where the restrictions were applied because the surface-worked brown rice has low residues such as occurring dust. Further, it was understood that since the surface-worked brown rice produced by the present invention had a higher water absorption rate than the conventional brown rice (FIG. 11), it was possible to improve the efficiency of cooking process and productivity by shortening immersion time.

TABLE 4

Turbidities of rinsing effluents of surface-worked brown rice, unprocessed raw brown rice, rinse-free rice and polished rice

| | Turbidity (ppm) | Polishing yield: (%) |
|---|---|---|
| surface-worked brown rice | 4.4 | 99.8 |
| Unprocessed raw brown rice | 2.0 | Unprocessed |
| Rinse-free rice | 21 | 88.3 |
| Polished rice | 92 | 90.8 |

With respect to the nutritional components and the like of the surface-worked brown rice prepared according to the present invention, since air dry matter or water immersion products having different amounts of water were tested, analysis was carried out based on dry matter equivalents (water content 0 g) in 100 g samples (Table 2). Although dry matter conversion value is suitable for accurate evaluation of the nutritional component amount, expression of contents in the air dry matter under general environmental conditions is practical for the purpose of comparing amounts of nutritional components of food materials.

Accordingly, the amounts of nutritional components of the surface-worked brown rice were converted to meet the moisture content (brown rice 14.9%) of "Japan Food Standard Component Table 2015 (Seventh Correction)" by the Ministry of Education, Culture, Sports, Science and Technology of Japan. Since cooking rice was generally carried out in unit of 1 Gou (Japanese traditional volume unit corresponding to 180 mL and to 150 g in the case of rice), the amounts of the nutritional components were also converted into the components contained per 150 g of the surface-work brown rice to carry out practical evaluation.

Further, the fill-rate of nutritional ingredients of surface-worked brown rice was based on "Japanese meal intake standards (2015 edition)" by Ministry of Health, Labour and Welfare, Japan. The target age classes were fixed on female aged 40-49 years (population ratio 7.4%) exhibited with a high peak in "Population estimation (August, 2017 Report)" by Statistics bureau, Ministry of Internal Affairs and Communications, Japan. For γ-aminobutyric acid, since the content increased by immersing before cooking, intake amount was calculated assuming that the general immersion time was 1 hour at room temperature (23° C.). The results are shown in Table 5 as nutritional contents in 1 Gou (150 g) of surface-worked brown rice, together with dietary intake standard of women in their 40s and satisfaction rate for the standard.

Fill-rates of nutrients for women in their 40s taking 1 Gou (150 g) of the surface-worked brown rice in Table 5 per day were high values of 50% or more for water-soluble vitamin $B_1$, vitamin $B_6$, and niacin, while pantothenic acid was also about 40%. For fat-soluble vitamin, vitamin E showed a high satisfaction rate of 40%. Dietary fiber intake of women in forties is 13 g according to "Nutrient intake (2015)" by Ministry of Health, Labour and Welfare, Japan, so that 5 g of dietary fiber intake is deficient against 18 g of the daily ingestion standard amount. Since, however, the amount of dietary fibers in Table 5 was 5.3 g, it is possible to compensate for the deficient amount by taking 1 Gou (150 g) of the surface-worked brown rice. Further, γ-oryzanol is told to be effective for psychosomatic disorders such as menopausal disorder because it has a central inhibitory action involved in catecholamine metabolism in the hypothalamus. Since the amount of γ-oryzanol in Table 5 was 53.9 mg, it is expected that 54 mg of γ-oryzanol gently moves into the body and exerts an inhibitory action on the central nervous system by eating daily 1 Gou (150 g) of the surface-worked brown rice.

About 20 mg of γ-aminobutyric acid was contained in 1 Gou (150 g) of the surface-worked brown rice after immersion for 1 hour. γ-Aminobutyric acid known as a neurotransmitter suppression compound is said to be unable to express physiological activity directly in the brain because it hardly pass through the blood-brain barrier. Since, however, intestinal nervous system inherent in gastrointestinal tract from esophagus to periproct cooperates with the central nervous system of the brain, it is thought that γ-aminobutyric acid released in association with digestion of the surface-worked brown rice has an influence on the central nervous system via the intestinal nervous system or the like. Although commercially available germinated brown rice contains a high concentration of γ-aminobutyric acid, concentration of γ-aminobutyric acid in cooked rice is low because the germinated brown rice is often cooked by adding about 30% to polished rice. Comparing this, since the surface-worked brown rice of the present invention is often cooked without addition of polished rice or the like, it is possible to eat cooked rice having a high γ-aminobutyric acid concentration.

The surface-worked brown rice produced by the present Example 1 had a rough surface formed by a large number of irregular and minute flaws and/or scrapes so that the immersion time in cooking was greatly shortened as compared with the unprocessed raw brown rice, and the texture was also improved. Since the surface-worked brown rice is ingested as holding embryo and aleurone layer in which nutrients are localized, the surface-worked brown rice is useful as a source of nutritional components such as vitamins and dietary fiber which tend to be deficient, while γ-oryzanol and γ-aminobutyric acid, which are supposed to exert inhibitory action in neuron system, can be ingested gradually as it is digested, so that it can be expected to act on psychosomatic disorders such as menopausal disorder.

Since the surface-worked brown rice has skin layer and aleurone layer, cooked surface-worked brown rice is slightly harder than cooked rice of polished rice having no skin layer nor aleurone layer, so that the number of chewing tends to increase. Increase in the number of chewing during ingesting improves various physiological functions, so that ingesting of the surface-worked brown rice is expected to contribute to health promotion.

TABLE 5

Nutritional contents in 1 Gou (150 g) of surface-worked brown rice, dietary intake standard of women in their 40s and satisfaction rate for the standard

| | 1 Gou (150 g) of surface-worked brown rice | Dietary intake standard | Fill-rate to dietary intake standard (%) |
|---|---|---|---|
| Vitamin $B_1$ (mg) | 0.7 | 1.1 | 63.6 |
| Vitamin $B_6$ (mg) | 0.6 | 1.2 | 50.0 |
| Vitamin E (mg) | 2.7 | 6 | 44.7 |
| Pantothenic acid (mg) | 1.5 | 4 | 37.5 |
| Niacin (mg) | 7.4 | 12 | 61.7 |
| Folic acid (μg) | 35.7 | 240 | 14.9 |
| Total dietary fiber (g) | 5.3 | 18 | 29.4 |
| γ-Oryzanol (mg) | 53.9 | — | — |
| γ-Aminobutyric acid (mg) | 20.4 | — | — |

From the above results, it was thought that the surface-working technology of the present invention realized precision rice polishing in which occurring rate of occurring dust was able to be controlled with 0.1% unit despite that partially polished rice of polishing yield 98% or higher (Polishing rate 2% or lower) was said to be difficult. It was also thought that the surface-work product was given with surface characteristics different from the raw brown rice so that cooking performance, sanitation, nutrition, texture and the like were improved.

Example 2

By the surface-working technique of the present invention, irregular and minute flaws and/or scrapes are formed on the skin layer of a granular cereal such as brown rice, wheat, barley, buckwheat or the like. Accordingly, in order to analyze quality of whole grain flour produced after the surface-working as pre-milling treatment, whole grain flour of wheat (herein after mentioned as "whole wheat flour") was prepared with a mortar type flour milling machine to measure particle size distribution with a laser diffraction particle size distribution meter (Beckman LS 13320). The amount of occurring dust occurring in the surface-working was adjusted to 0.5% (corresponding to Polishing rate for rice) of the raw wheat, Yumekaori. For comparison, the same test was carried out using unprocessed raw wheat, Yumekaori, without surface-working as pre-milling treatment. The results were shown in FIG. 12 and Table 6.

FIG. 12A shows a particle size distribution chart of whole wheat flour (A) milled after surface-working, while FIG. 12B shows a particle size distribution chart of whole wheat flour (B) milled without surface-working (unprocessed raw wheat). The lower row of Table 6 shows average particle diameters measured by laser diffraction particle size distribution meter and reduction rate thereof. The average particle size of wheat whole wheat flour produced after the surface-working in FIG. 12A was 0.159 mm, and the peak (a) of the fine fraction of the embryo part was 0.024 mm. The average particle size of whole wheat flour of unprocessed raw wheat in FIG. 12B was 0.174 mm, and the peak (b) of the fine fraction in the embryo part was 0.029 mm. The average particle size of whole wheat flour reduced by 8.6% by the surface-working treatment showing that the average particle diameter was reduced by the surface-working. As for the peak of the fine fraction, the whole wheat flour subjected to the surface-working showed higher value than the unprocessed whole wheat flour.

From the lower row of Table 6, the milling after the surface-working showed a reduction in the average particle diameter. Since, however, the laser diffraction particle size distribution meter is calibrated with granular garnet standard particles, the average particle diameter measurement is prone to an error, because the whole grain powder contains a lot of flat bran fractions. Therefore, the influence of the surface-working technology on the flour milling of wheat was examined using sieve method which was widely used at food production factory. Analysis was carried out by shaking the whole wheat flour using a sieve having an opening diameter of 0.710 mm (JIS 8801) to measure the weight of the sieve residue containing a large amount of bran fraction which remained on the sieve. The results were shown in the upper row of Table 6.

The upper part of Table 6 shows the amounts of sieve residues of the whole wheat flours prepared from the surface-worked wheat and the unprocessed raw wheat using a mortar type milling machine respectively. In the lower part of Table 6, the measured values of the average particle diameters by the above-mentioned laser diffraction particle size distribution meter and the reduction rate by the surface processing treatment are shown. From Table 6, it was found that the amount (0.65%) of the sieve residue of the whole wheat flour milled after the surface-working decreased by 23.5% as compared with the sieve residue amount (0.85%) of the whole grain flour of the unprocessed wheat grain so that the quality of the whole wheat flour was improved by the surface-working as pre-milling treatment.

As mentioned above, in the measurement of the average particle diameter using the laser diffraction particle size distribution meter, the average particle diameter of the whole wheat flour milled after the surface-working treatment was reduced by 8.6%. From the result of the reduction rate of the sieve residue amount, it was thought that the reduction of the average particle diameter was caused by increase in the small particle size fraction by pulverizing the coarse bran fraction of the whole wheat flour of the surface-worked wheat.

A coarse bran fraction of whole wheat flour is said to cut off a thin film of gluten matrix to cause leakage of retained carbon dioxide gas and the like, adversely affecting oven spring in bread making. Also, in the production of noodles, it causes a noodle cut off and falling. It was thought that applying the surface-working treatment to the raw wheat as pretreatment for production of whole wheat flour brings about a reduction effect of the coarse bran fraction contributing to improvement of processing characteristics such as bread making property and noodle making property.

TABLE 6

Effects of Surface-working on sieve residue and average particle size of whole wheat flour

| | Surface-worked wheat | Unprocessed raw wheat | Reduction rate (%) |
|---|---|---|---|
| Sieve residue (%) | 0.65 | 0.85 | 23.5 |
| Average particle size (mm) | 0.159 | 0.174 | 8.6 |

INDUSTRIAL APPLICABILITY

The present invention is applied to an apparatus and a process for producing a surface-worked granular product and to surface-worked granular product obtained by the process and processed goods, wherein by removing foreign substances adhering granular material is removed and surface-working of granular raw food material originating from a plant seed, or other granular material is carried out using a cylindrical retainer and a rotary working device to form a rough surface without causing degeneration, denaturation or substantial removal of useful material so that a surface-worked granular product having surface characteristics different from raw granular material can be produced.

EXPLANATION OF THE SYMBOL

1: production apparatus, 2: granular material, 2*a*: raw granular material, 2*b*: granular product, 3: cylindrical retainer, 3*a*: retaining site, 3*b*: aperture, 3*c*, 3*d*: perforated plate, 3*e*: passage, 4: rotary working device, 4*a*, 4*b*, 4*c*: surface-roughening tool, 4*aa*, 4*ba*, 4*ca*: working protrusion, 4*ab*, 4*bb*, 4*cb*: disk, 4*d*: releasing/dispersing tool, 4*da*: releasing vane, 4*db*: temporarily storing portion, 4*dc*: base portion, 4*u*: working unit, 5: wear member, 5*a*: convex, 5*b*: concave, 6: rotary shaft, 7, 7*a*: diameter adjustment means, 7*b*, 7*c*: holding member, 7*d*: binding jig, 8: occurring dust discharge site, 8*a*: occurring dust collector, 8*b*: occurring dust discharge path, 8*c*: occurring dust, 9: crushed material discharge site, 9*a*: crushed material receiver, 9*b*: crushed material discharge path, 9*c*: crushed material, 11: engaging tool, 11*a*: key, 11*b*: groove, 12: gap, 13: worked product takeout path, 14: sorting site, 15: product takeout site, 16: fixing tool, 17: raw material supply site, 17*a*: conveyor cylinder, 17*b*: stabilizing plate, 17*c*: opening, 17*d*: supply channel, 18: screw conveyor, 19, 19*a*: holding member, 20, 20*a*: support member, 21: driving device, 22: coupling, 23: end-fixing tool, 24: bearing.

What is claimed:

1. A process of producing a surface-worked granular product, comprising:

supplying raw granular material to a cylindrical retainer declining, with respect to the horizontal, toward a product takeout site from a raw material supply site, and having apertures and retaining sites for temporarily retaining each granule of the raw granular material circling and traveling along an inner surface of the cylindrical retainer, the cylindrical retainer having a passage for the raw granular material between the inner surface of the cylindrical retainer and a rotary working device connected to a rotary shaft extending along a central longitudinal axis of the cylindrical retainer, wherein the passage comprises a ring-shaped space extending along the central longitudinal axis, and wherein the apertures in an upper part of the cylindrical retainer are covered with an occurring dust collector of saddle shape which is installed further to cover the apertures in the upper part of an upward rotation side where rotation of the rotary working device is upward, floating the raw granular material in the passage of the upward rotation side by suctioning air from the occurring dust collector through the apertures, thereby creating a floated granular material in the passage of the upward rotation side, rotating the rotary working device to fluidize the floated granular material in the passage of the upward rotation side and to cause the floated granular material to circle and travel in a floated and fluidized state throughout a whole circumference of the passage wherein the floated granular material in the passage moves to go back and forth between the cylindrical retainer and the rotary working device in a spiral shape of total movement along the inner surface of the cylindrical retainer, thereby creating a floated and fluidized granular material, providing a working protrusion which extends from an outer surface of the rotary working device, and contacting the floated and fluidized granular material in the passage with the working protrusion to remove foreign substances and to form a number of irregular and minute scrapes on a skin layer of the floated and fluidized granular material without degeneration, denaturation or substantial removal of useful ingredients so as to impart surface characteristics on the skin layer different from the raw granular material, wherein a polishing yield of the raw granular material is 99.8 to 99.9%.

2. The process as claimed in claim 1, wherein the raw granular material is a granular material originated from grains or seeds of plants.

3. A surface-worked granular product of raw granular material, comprising:

a skin layer, a number of irregular and minute scrapes formed on the skin layer without degeneration, denaturation or substantial removal of useful ingredients, and a polishing yield of 99.8 to 99.9%, wherein surface characteristics on the skin layer are different from the raw granular material, wherein said number of irregular and minute scrapes are formed on the skin layer by a rotary working device rotating to contact with floated and fluidized granular material accompanied with neither crushing of a granule nor peeling of a surface thereof, wherein the skin layer, an aleurone layer and an embryo of the raw granular material are not removed, and wherein the surface-worked granular product is obtained by the process as claimed in claim 1.

4. A surface-worked granular product of raw granular material, comprising:

a skin layer, a number of irregular and minute scrapes formed on the skin layer without degeneration, denaturation or substantial removal of useful ingredients, a polishing yield of 99.8 to 99.9%, wherein surface characteristics on the skin layer are different from the raw granular material, wherein said number of irregular and minute scrapes are formed on the skin layer by a rotary working device rotating to contact with floated and fluidized granular material accompanied with neither crushing of a granule nor peeling of a surface thereof, and wherein the skin layer, an aleurone layer and an embryo of the raw granular material are not removed.

5. The surface-worked granular product, as claimed in claim 4, wherein the raw granular material originated from grains or seeds of plants.

6. Processed goods, comprising:

secondary processed goods of the surface-worked granular product as claimed in claim 4.

* * * * *